US007748808B2

(12) United States Patent
Umeda et al.

(10) Patent No.: US 7,748,808 B2
(45) Date of Patent: Jul. 6, 2010

(54) DROPLET EJECTION APPARATUS AND INKJET RECORDING APPARATUS

(75) Inventors: Takaichiro Umeda, Nagoya (JP); Hiroaki Yazawa, Nagoya (JP); Hisaki Sakurai, Nagoya (JP); Hikaru Kaga, Aisai (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 834 days.

(21) Appl. No.: 11/588,522

(22) Filed: Oct. 27, 2006

(65) Prior Publication Data

US 2007/0097189 A1 May 3, 2007

Related U.S. Application Data

(63) Continuation-in-part of application No. 11/385,930, filed on Mar. 22, 2006, now abandoned, and a continuation-in-part of application No. 11/386,095, filed on Mar. 22, 2006, now Pat. No. 7,641,326.

(30) Foreign Application Priority Data

Oct. 27, 2005 (JP) ..... 2005-313278

(51) Int. Cl.
*B41J 2/195* (2006.01)
*B41J 29/393* (2006.01)
*B41J 2/17* (2006.01)
*B41J 2/175* (2006.01)

(52) U.S. Cl. ..... 347/7; 347/19; 347/84; 347/85; 347/86

(58) Field of Classification Search ..... 347/85, 347/86, 84, 19, 7
See application file for complete search history.

(56) References Cited

U.S. PATENT DOCUMENTS 5,371,529 A 12/1994 Eguchi et al.
6,050,680 A * 4/2000 Moriyama et al. ..... 347/85
6,341,852 B1 1/2002 Yamamoto
6,517,178 B1 2/2003 Yamamoto et al.
6,561,608 B1 5/2003 Yamamoto et al.

(Continued)

FOREIGN PATENT DOCUMENTS

JP 5-201024 8/1993

(Continued)

*Primary Examiner*—Stephen D Meier
*Assistant Examiner*—Sarah Al-Hashimi
(74) *Attorney, Agent, or Firm*—Frommer Lawrence & Haug LLP

(57) ABSTRACT

A droplet ejection apparatus includes a plurality of tanks, a plurality of sub-tanks, a replenishment amount detector, a liquid replenisher and a recording head. Each of the plurality of tanks is capable of storing a different kind of basic liquid. The plurality of sub-tanks includes a first sub-tank that includes a mixed liquid of two or more of the different kinds of the basic liquids from the plurality of tanks. The replenishment amount detector detects amount of each of the different kinds of the basic liquids to be transferred to the first sub-tank. The liquid replenisher transfers the basic liquids stored in the tanks into the sub-tanks until a predetermined amount for each of the basic liquids is detected by the replenishment amount detector. The recording head ejects the liquids supplied from the sub-tanks in a form of droplets.

28 Claims, 19 Drawing Sheets

U.S. PATENT DOCUMENTS

| | | | | |
|---|---|---|---|---|
| 2003/0202059 | A1* | 10/2003 | Kimura et al. | 347/85 |
| 2005/0022595 | A1* | 2/2005 | Eguchi et al. | 73/304 R |
| 2005/0116997 | A1* | 6/2005 | Katoh et al. | 347/84 |

FOREIGN PATENT DOCUMENTS

| | | |
|---|---|---|
| JP | 6-293142 | 10/1994 |
| JP | 2000-246920 | 9/2000 |
| JP | 2000-246950 | 9/2000 |
| JP | 2001-88279 | 4/2001 |
| JP | 2001219585 | 8/2001 |

* cited by examiner

Y
C
M
Bk
C
Y
M
B
R
G
Pb
29
30
31
32
33
34
35
36
37
38
39
40
42

DROPLET EJECTION APPARATUS AND INKJET RECORDING APPARATUS

CROSS-REFERENCE TO RELATED APPLICATIONS

This application claims the benefit of Japanese Patent Application No. 2005-313278 filed Oct. 27, 2005, the disclosure of which is incorporated herein by reference. This is a Continuation-in-Part of application Ser. No. 11/385,930 filed Mar. 22, 2006 now abandoned and Ser. No. 11/386,095 filed Mar. 22, 2006 now U.S. Pat. No. 7,641,326, the disclosure of which are incorporated herein by reference.

BACKGROUND

This invention relates to a droplet ejection apparatus that ejects liquid supplied from sub-tanks as droplets. Particularly, this invention is effective when it is applied to an inkjet recording apparatus (inkjet printer).

A known inkjet recording apparatus includes an ejection head that ejects ink as a droplet and an ink tank that supplies ink to the ejection head. The prior inkjet recording apparatus could produce ink with various hues to match user's taste since a user himself mixes the plurality colors of ink in an ink mixing container, which is provided to the user separately from the inkjet recording apparatus, and the user himself replenishes and supplies mixed ink to the ink tank.

However, there is a high possibility that the hue of mixed ink is different from that of previous mixed ink every time ink is replenished, since the user himself mixes the plurality colors of ink in the ink mixing container, which is provided to the user separately from the inkjet recording apparatus, and the user himself replenishes and supplies mixed ink to the ink tank.

In other words, the hue of mixed ink is determined by the original mixing ratio of the plurality colors of basic ink. Therefore, it is necessary to constantly produce mixed ink with a uniform mixed ratio so as to produce the mixed color with a uniform hue.

However, it is difficult to replicate the amount of ink being injected to the ink mixing container each time a user mixes ink, since the user pours the plurality colors of basic ink in the ink mixing container and mixes them together. Thus, it results in difficulty of producing mixed ink with the uniform mixed ratio all the time.

Consequently, the prior art has a problem that it is very difficult to replicate the hue since the hue of mixed ink differs every time mixed ink is replenished.

SUMMARY

In consideration of the above and other problems, one purpose of the present invention is to enable the mixing ratio to be easily replicated in the apparatus which includes a droplet ejection apparatus such as an inkjet recording apparatus.

In one aspect of the present invention, there is provided a droplet ejection apparatus which includes a plurality of tanks, a plurality of sub-tanks, a replenishment amount detector, a liquid replenisher and a recording head. Each of the plurality of tanks is capable of storing a different kind of basic liquid. The plurality of sub-tanks includes a first sub-tank that includes a mixed liquid of two or more of the different kinds of the basic liquids from the plurality of tanks. The replenishment amount detector detects amount of each of the different kinds of the basic liquids to be transferred to the first sub-tank. The liquid replenisher transfers the basic liquids stored in the tanks into the sub-tanks until a predetermined amount for each of the basic liquids is detected by the replenishment amount detector. The recording head ejects the liquids supplied from the sub-tanks in a form of droplets.

Due to this configuration, in the present invention, plurality kinds of basic liquid is replenished to the first sub-tanks while the replenishment amount of each plurality kinds of basic liquid to be replenished is automatically detected. Consequently, it enables the accurate mixing ratio of the mixed liquid in the first sub-tanks to be stabilized.

BRIEF DESCRIPTION OF THE DRAWINGS

The invention will now be described below, by way of example, with reference to the accompanying drawings, in which.

DETAILED DESCRIPTION OF THE PREFERRED EMBODIMENT

According to embodiments of the present invention, an inkjet recording apparatus using a droplet ejection apparatus is applied to a multifunction apparatus, which may include a printer function, a scanner function, a copy function, and a facsimile function.

First Embodiment

1. Overall Structure of Multi Function Apparatus 10

Figure 1:
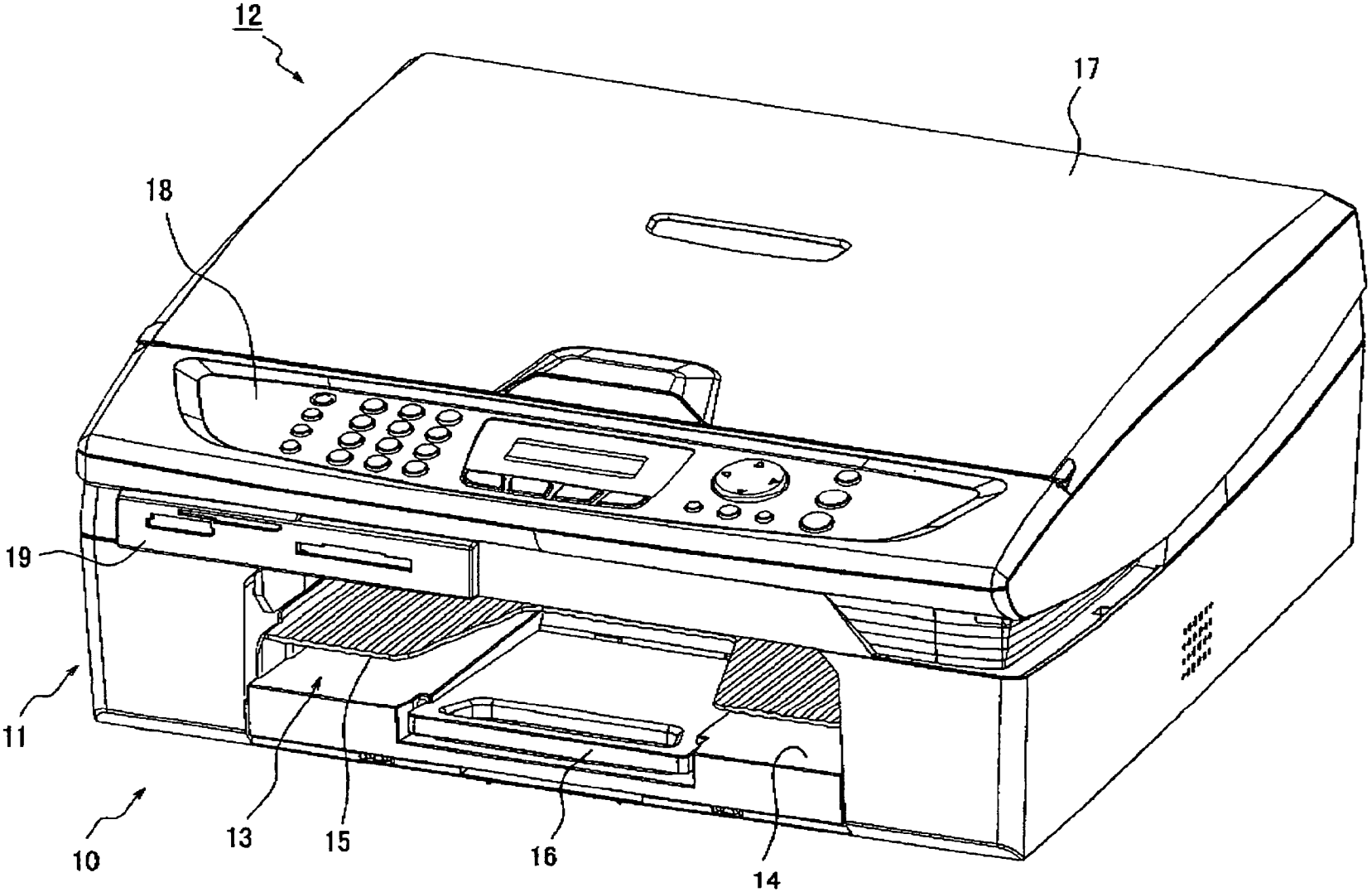
FIG. 1 is an external view of a multifunction apparatus according to an embodiment of the present invention.

Referring to FIG. 1, a multifunction apparatus 10 is provided with an inkjet printer unit 11 in the lower portion thereof, and a scanner unit 12 in the upper portion.

The printer unit 11 is provided with an opening 13, a paper feed tray 14, and a paper discharge tray 15. The opening 13 is disposed in the front surface of the printer unit 11. The paper feed tray 14 and the paper discharge tray 15 are disposed on top of another so as to be exposed from the opening 13. The paper feed tray 14 stores recording paper. Recording paper stored in the paper feed tray 14 is fed to the inside of the printer unit 11. A predetermined image is recorded on the recording paper. Then, the recording paper is discharged onto the paper discharge tray 15.

The paper feed tray 14 is provided with a slide tray 16. The slide tray 16 is slid out, if necessary, so as to enlarge the tray surface. The scanner unit 12 is composed as a so-called flatbed scanner, and provided with a platen glass (not shown) and an image reading device (not shown) under a cover 17 which covers, from upside, an original to be read. The image reading device includes a CIS (Contact Image Sensor) and a CCD (Charge-Coupled Device).

The platen glass is used so as to place an original thereon. The image reading device is disposed under the platen glass so as to be able to scan the entire surface of a placed original. The multifunction apparatus 10 is furthermore provided with an operation panel 18, which is used so as to operate the printer unit 11 or the scanner unit 12. The operation panel 18 is provided with various operation buttons and a liquid crystal display unit. The multifunction apparatus 10 is operated according to an operation instruction from the operation panel 18 or an instruction sent from a computer via a printer driver.

2. Structure of Printer Unit 11 (Inkjet Recording Apparatus)

2.1 Overall Structure

Figure 2:
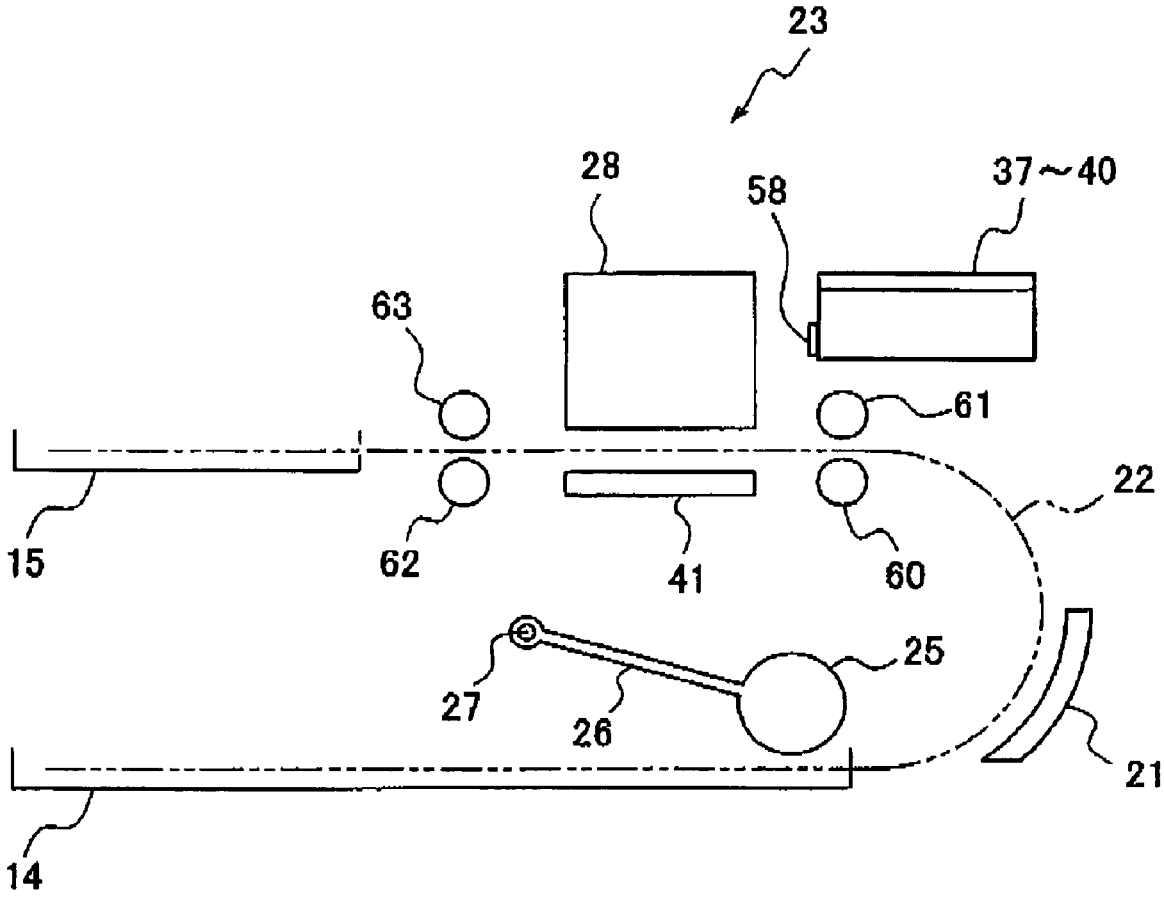
FIG. 2 is a diagram showing a structure of an inkjet recording apparatus according to an embodiment of the present invention.

Referring now to FIG. 2, on the bottom of the multifunction apparatus 10 (printer unit 11), the paper feed tray 14 is disposed wherein a number of sheets of recording paper is placed. In the back side of the paper feed tray 14 (on the right side in the drawing), an inclined separation board 21 is provided so as to separate sheets of recording paper placed on the paper feed tray 14 and guide the recording paper toward the upside.

A conveyance path 22 of recording paper is formed upward from the inclined separation board 21. The conveyance path 22 is firstly extended upward, curved toward the left side in the drawing, furthermore extended from the back side of the multifunction apparatus 10 toward the front side thereof, and reaches the paper discharge tray 15 via an image recording unit 23.

As a result, recording paper stored in the paper feed tray 14 is guided to the image recording unit 23 through the conveyance path 22 so as to make a U-turn from the lower side to the upper side. After an image is recorded on the recording paper by the image recording unit 23, the recording paper is discharged onto the paper discharge tray 15.

A paper feed roller 25 is provided so as to separate recording paper stacked on the paper feed tray 14 in a sheet-by-sheet manner and supply the recording paper a sheet by sheet to the conveyance path 22. The structure of the paper feed roller 25 is the same as that of a known paper feed roller. That is to say, the paper feed roller 25 is, for example, supported on a leading end of a paper feed arm 26, which moves upward and downward, so that the paper feed roller 25 can be in contact with the paper feed tray 14 and separated therefrom. The paper feed roller 25 is connected to a motor via a drive transmission mechanism. The paper feed arm 26 is disposed so as to be rotatable around an axis 27 of the trailing end. The paper feed arm 26 is flipped upward by a paper feed clutch, a spring, or the like (not shown) when the printer unit 11 is in a standby state, and swung down when recording paper is fed.

2.2 Image Recording Unit 23

Figure 3:
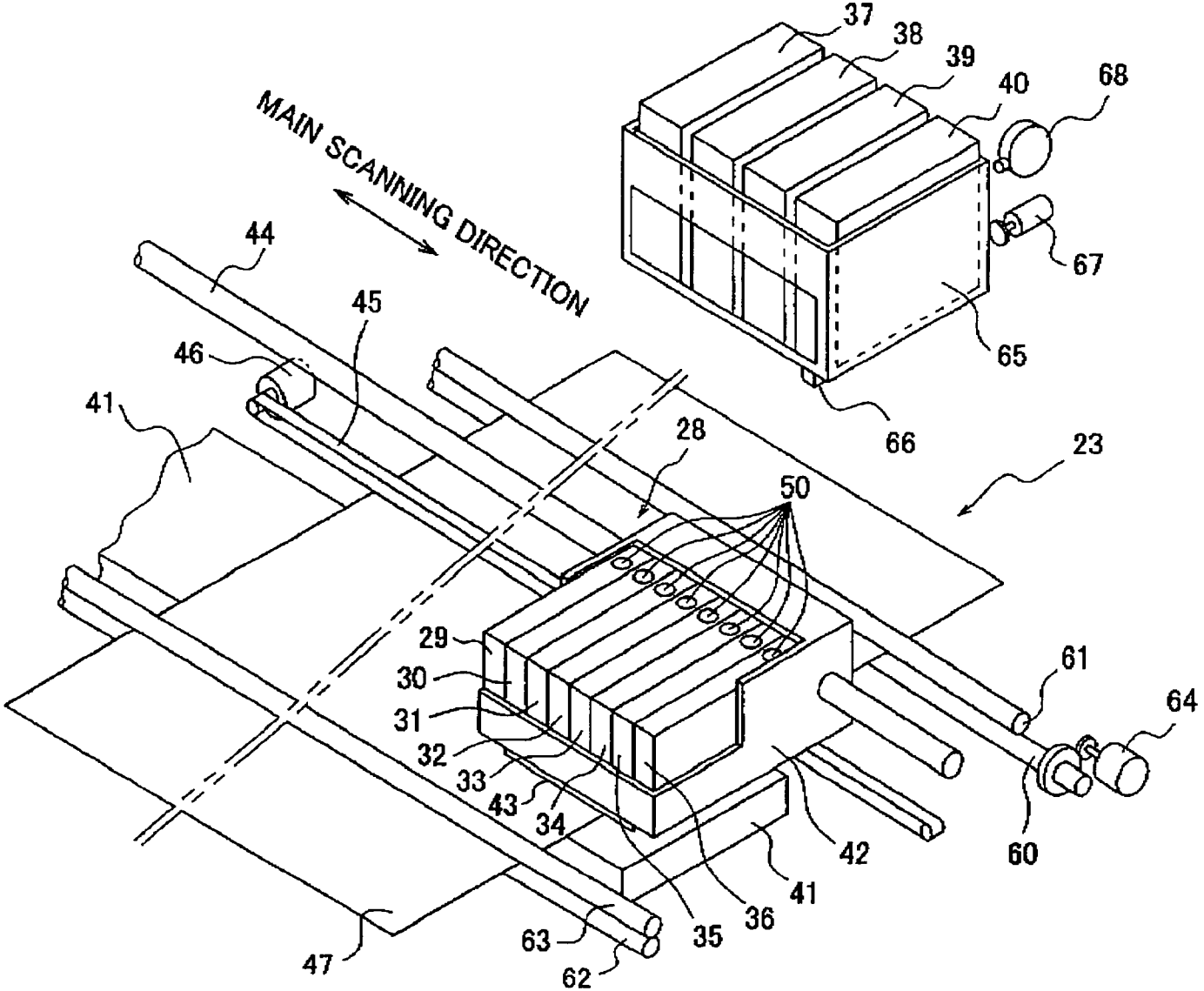
FIG. 3 is a diagram showing a structure of an image recording unit of the inkjet recording apparatus according to an embodiment of the present invention.

Referring now to FIG. 3, the image recording unit 23 is provided with a head unit 28, a platen 41, a recording head 43, sub-tanks 29-36, cartridge-type ink tanks 37-40, and so forth. The platen 41 is disposed so as to face the head unit 28. The recording head 43 ejects (discharges) ink. The sub-tanks 29-36 store ink to be supplied into the recording head 43. The ink tanks 37-40 store ink to be supplied into the sub-tanks 29-36. Although the ink tanks 37-40 are shown larger than the sub-tanks 29-36 in FIG. 3 so as to facilitate understanding, the ink tanks 37-40 and the sub-tanks 29-36 can be approximately the same size in order to facilitate ink supply.

The image recording unit 23 records an image on recording paper 47, while the head unit 28 moves in a main scanning direction, by ejecting various colors of inks, such as cyan (C), magenta (M), yellow (Y), black (Bk), and so forth from the head unit 28 onto the recording paper 47 intermittently conveyed on the platen 41.

The recording head 43 and the sub-tanks 29-36 are held by a scanning carriage 42. The recording head 43 is disposed so as to be exposed on the bottom surface of the scanning carriage 42. The sub-tanks 29-36 are disposed on the upper side of the recording head 43 of the scanning carriage 42.

A guide shaft 44, extending in the main scanning direction, is included to guide and support the scanning carriage 42 so that the scanning carriage 42 can be moved thereon. An endless belt 45 is disposed in parallel to the guide shaft 44 so that the scanning carriage 42 (head unit 28) can be moved thereon. The endless belt 45 is driven by a belt drive motor 46 via a pulley.

Figure 4:
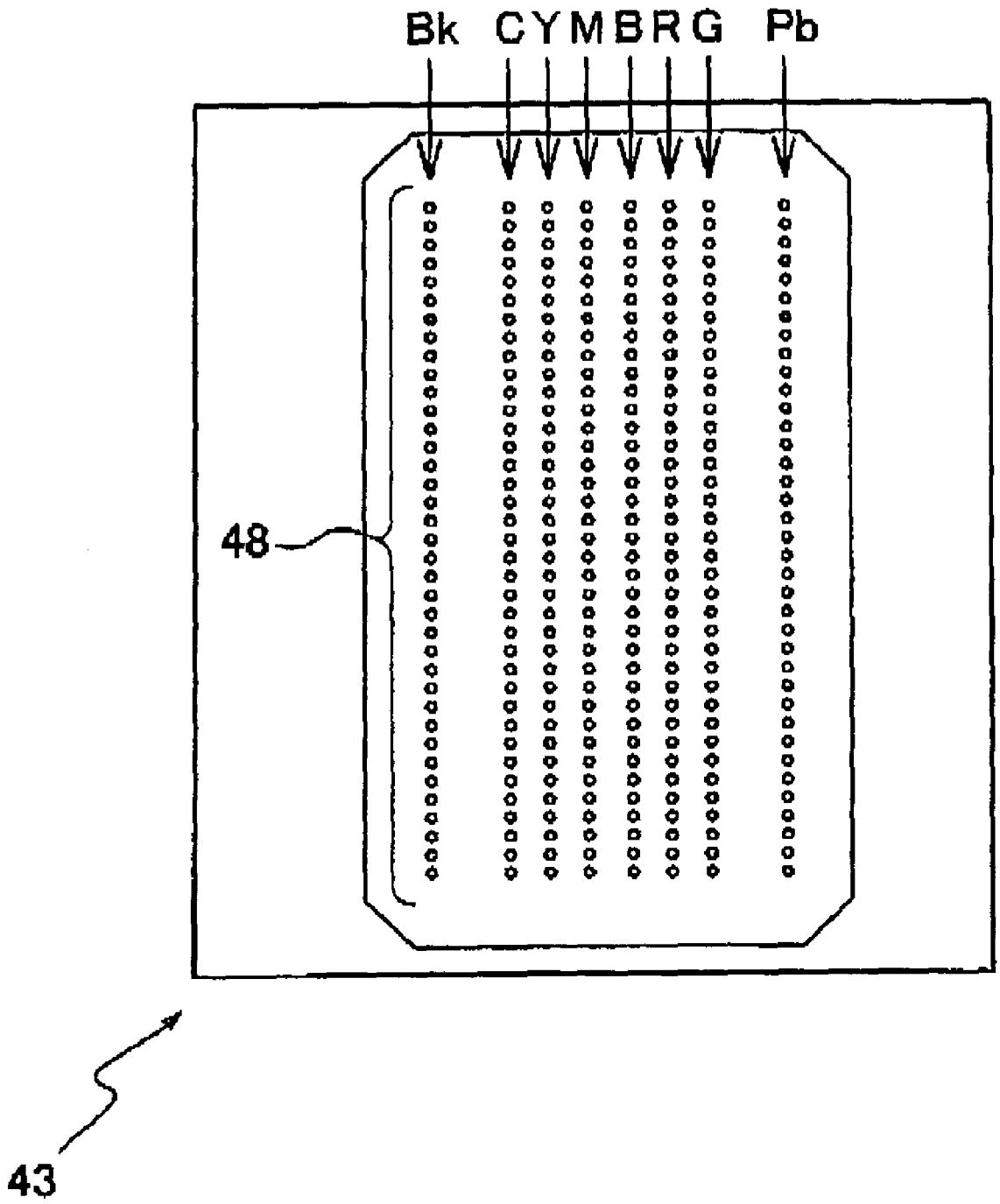
FIG. 4 is a diagram showing the bottom surface of a recording head according to an embodiment of the present invention.

On the bottom surface of the recording head 43, arrays of ejection nozzles 48 are aligned substantially in one line as shown in FIG. 4. The number of these arrays corresponds to the number of sub-tanks 29-36.

From the ink ejection nozzles 48 in the array disposed in the left end side in the drawing, black ink (to be referred to as ink Bk) is ejected. Hereinafter, in the order of the alignment of the ejection nozzles 48, cyan ink (to be referred to as ink C), yellow ink (ink Y), magenta ink (ink M), blue ink (ink B), red ink (ink R), green ink (ink G), and Photo Black ink (ink Pb) are ejected from the ejection nozzles 48 in respective arrays.

Figure 5:
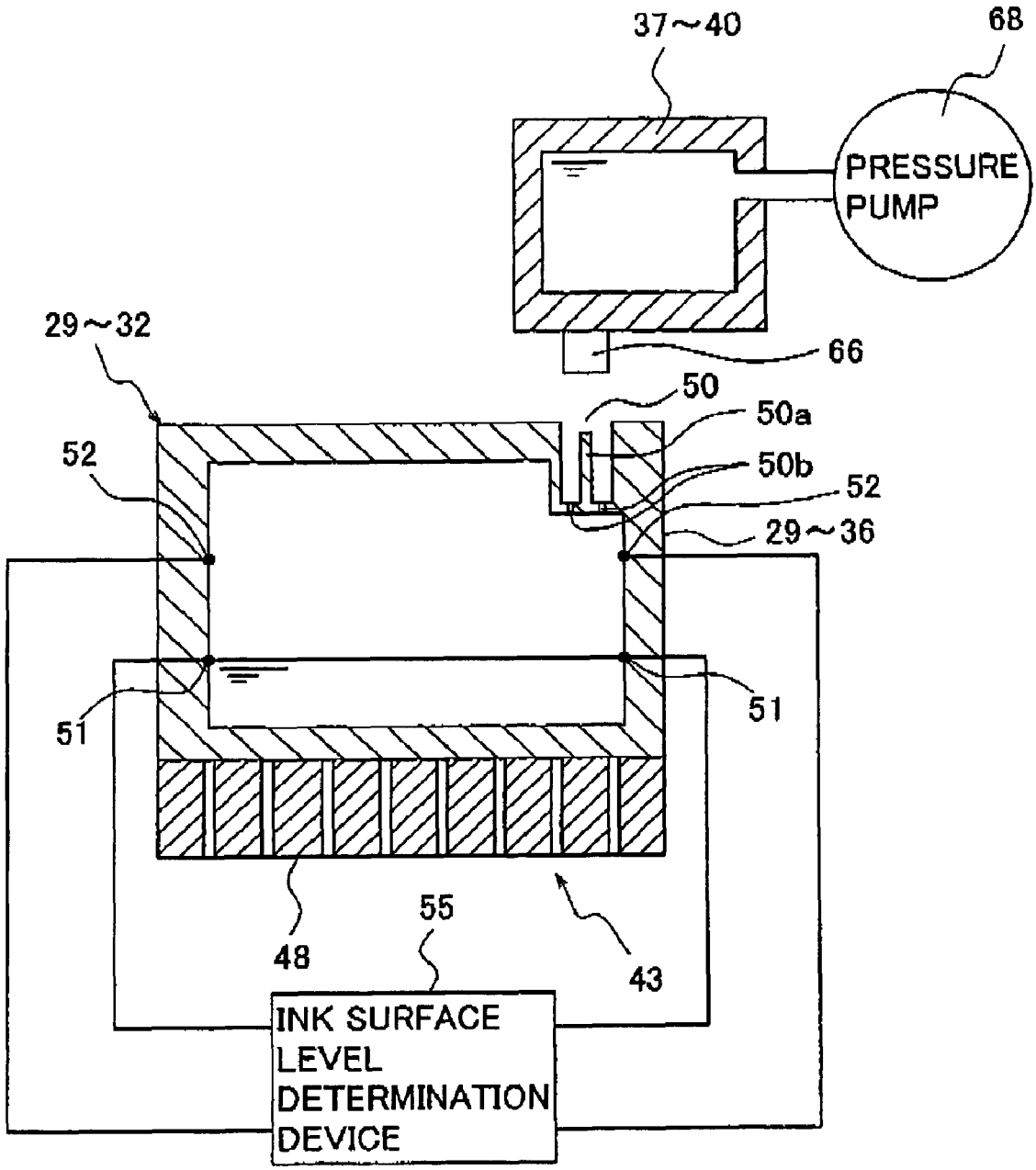
FIG. 5 is a sectional diagram showing the recording head and a sub-tank according to an embodiment of the present invention.
Figure 6:
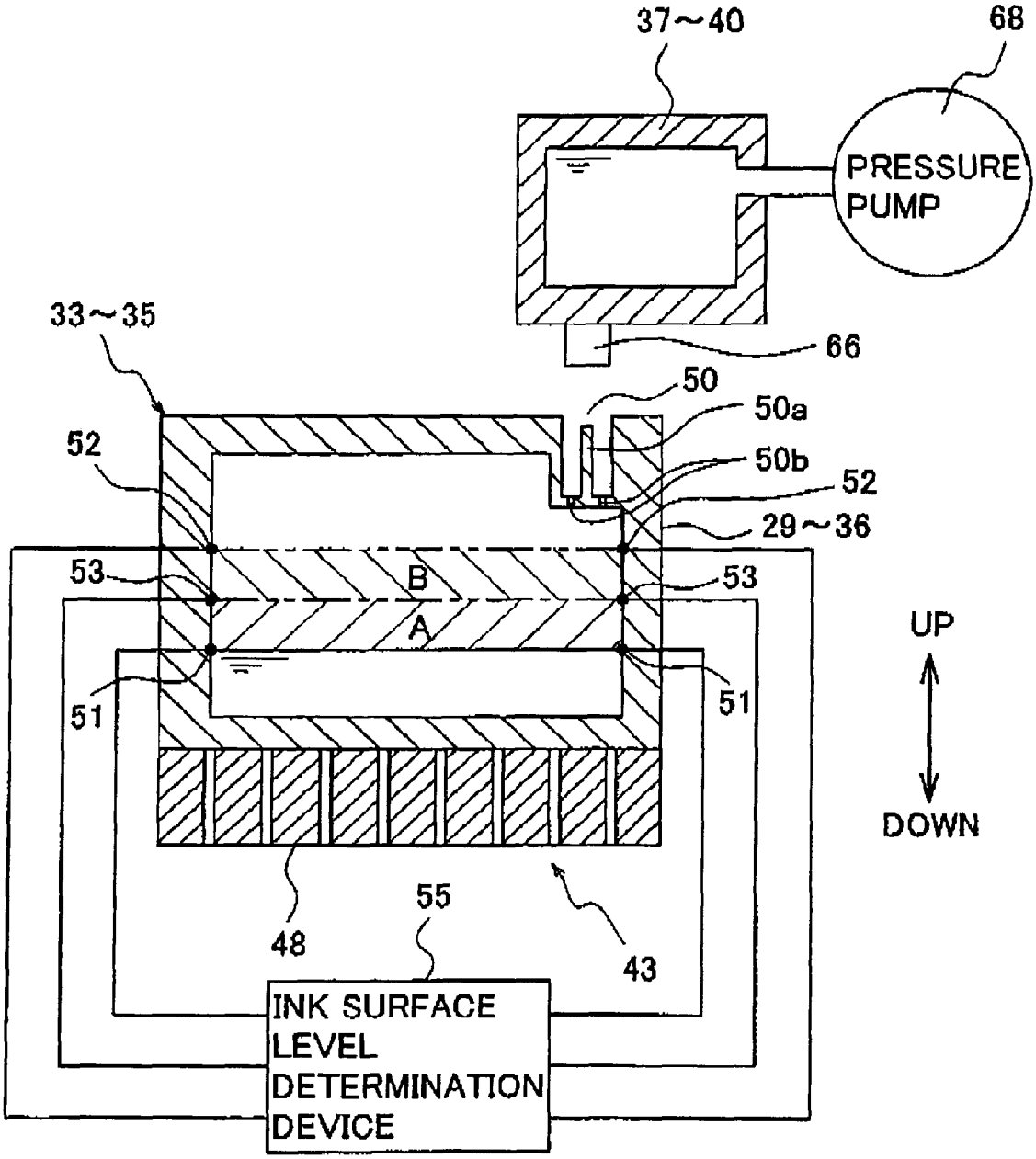
FIG. 6 is a sectional diagram showing the recording head and the sub-tank according to an embodiment of the present invention.
Figure 7:
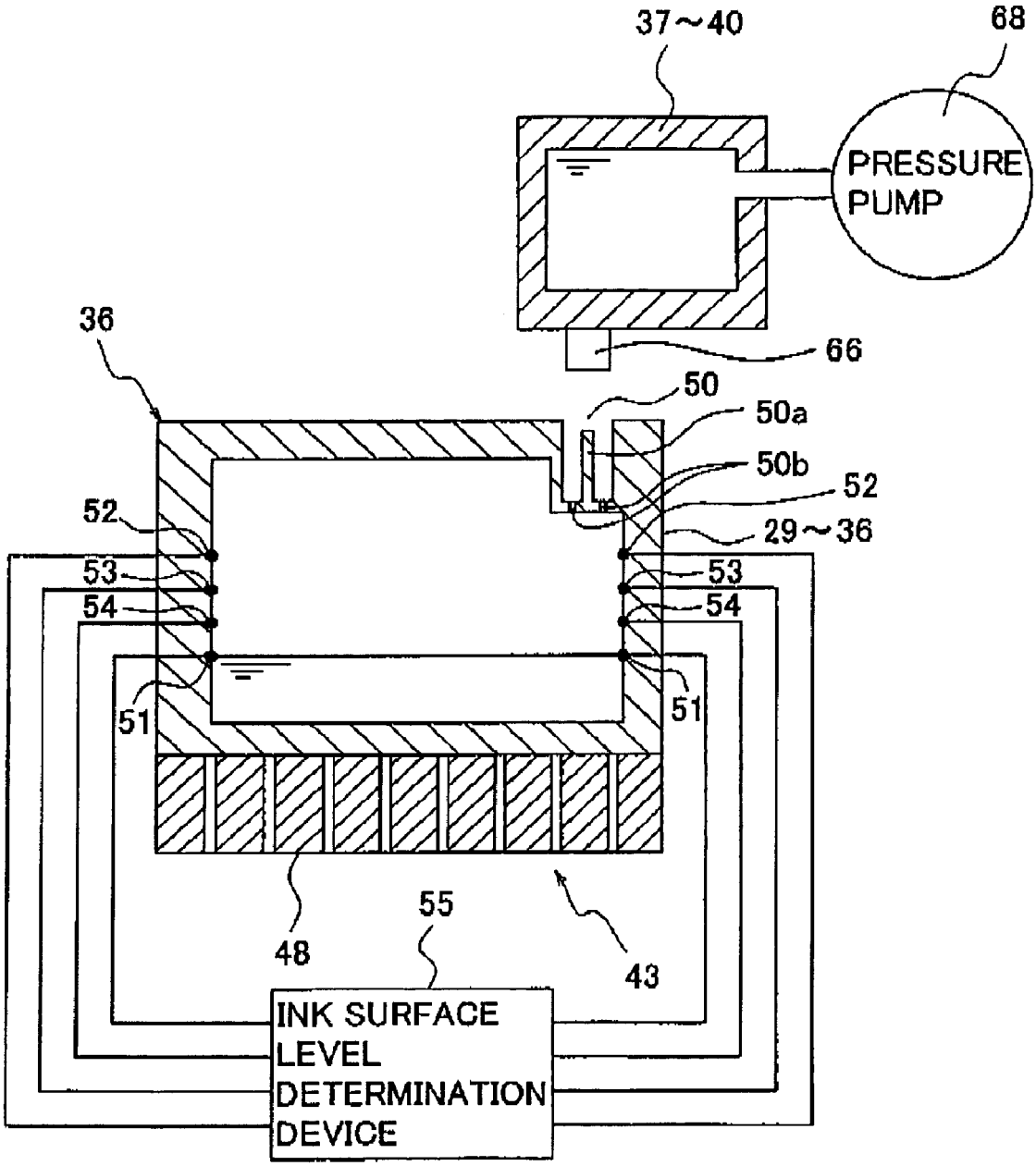
FIG. 7 is a sectional diagram showing the recording head and the sub-tank according to an embodiment of the present invention.

The recording head 43 according to the present embodiment is a piezo-type recording head which ejects ink by the use of piezoelectric element (piezo element). As shown in FIG. 5 to FIG. 7, the recording head 43 receives ink supply from the sub-tanks 29-36 disposed on the top side of the recording head 43, and ejects (discharges) ink toward recording paper.

On the top surface of each of the sub-tanks 29-36, an ink supply hole 50 is disposed for ink supplied from the ink tanks 37-40. In the bottom portion of the ink supply hole 50, a push rod 50*a* is provided for opening an on-off valve 58 (see FIG. 8) disposed in each of the ink tanks 37-40. On the root portion of the push rod 50*a*, communication holes 50*b* are provided so that each supply hole 50 is communicated with one of the sub-tanks 29-36.

2.3 Ink Tanks 37-40

The ink tanks 37-40 are replenishment tanks wherein ink is stored so as to be replenished into the sub-tanks 29-36. Here, the number of the ink tanks 37-40 is less than the number of the sub-tanks 29-36 as shown in FIG. 3. In the ink tanks 37-40, ink to become the basis for basic color (to be referred to as basic ink) is stored respectively.

The basic ink, mentioned here, is in some colors which compose the basis of the colors of ink stored in respective sub-tanks 29-36. Four colors of ink: ink Bk, ink C, ink Y, and ink M can be employed as the basic ink.

The ink tanks 37-40 are held by a holder 65. On the bottom portion of respective ink tanks 37-40, a connecting portion 66 is provided so as to be connected to the above-described supply opening 50 of respective sub-tanks 29-36.

Figure 8A:
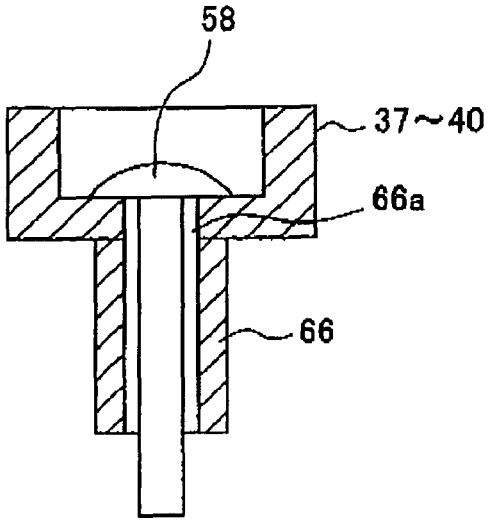
FIGS. 8A and 8B are sectional diagrams showing a connecting portion of an ink tank according to an embodiment of the present invention.
Figure 8B:
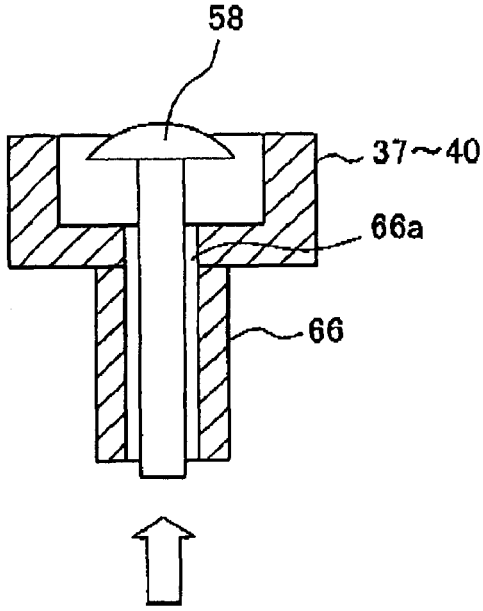

Inside of the connecting portion 66, the on-off valve 58, which opens and closes an ink replenishment opening 66*a* disposed within the connecting portion 66, is provided as shown in FIGS. 8A and 8B. The on-off valve 58 opens the ink replenishment opening 66*a* by being pressed by the push rod 50*a* when the connecting portion 66 is connected to the supply opening 50. When the connecting portion 66 is removed from the supply opening 50, the on-off valve 58 closes the ink replenishment opening 66*a* by the pressure of ink in respective ink tanks 37-40 and the resilient force of a spring, which is not shown in the drawing.

The ink tanks 37-40 are respectively provided with a slide cylinder 67 and a pump 68 as shown in FIG. 3. The slide cylinders 67 provide driving force so as to individually lower the ink tanks 37-40 toward the sub-tanks 29-36. The pumps 68 pressurize inside of the ink tanks 37-40. Respective slide cylinders 67 and the pumps 68 can be fixed to the holder 65.

In FIG. 3, only one slide cylinder 67 and one pump 68 of the ink tank 40 are shown in order to simplify the drawing. Additionally, in FIG. 3, the slide cylinder 67 is disposed so as to provide the driving force of the slide cylinder 67 from the back side of the ink tanks 37-40. However, the driving force of the slide cylinder 67 is provided to link mechanisms or the like, which are not shown in the drawing and respectively provided to each of the ink tanks 37-40. The driving force is converted into driving force which lowers the ink tanks 37-40 toward the sub-tanks 29-36, and then, provided to the ink tanks 37-40. Although the connection between the pump 68 and the ink tank 40 is not shown in FIG. 3 in order to simplify the drawing, pumps 68 are respectively connected to the ink tanks 37-40 via, for example, tubes (see FIGS. 5, 6 and 7).

2.4 Sub-Tanks

There are two kinds of sub-tanks in the sub-tanks 29-36. One is a basic color sub-tank, wherein an identical color of basic ink only is supplementary supplied. The other is a mixed color sub-tank, wherein plural colors of basic ink are mixed and supplied. In this embodiment according to the present invention, the sub-tanks 29-32 correspond to the basic color sub-tank, and the sub-tanks 33-36 correspond to the mixed color sub-tank.

Moreover, each sub-tanks 29-36, as shown in FIG. 5 to FIG. 7, has a first electrode 51 (in this configuration the electrode constitutes a pair) to detect whether or not ink stored in the sub-tanks 29-36 becomes the predetermined minimum amount, and a second electrode 52 (in this configuration the electrode is a pair of electrodes) to detect whether or not ink replenished in sub-tanks 29-36 becomes the predetermined maximum amount.

More specifically, when the amount of ink (the level of ink liquid surface) in the sub-tanks 29-36 conforms with the position (height) where the first electrode 51 is disposed, a electronic resistance value between a pair of the first electrode 51 changes, and the ink surface level determination device 55 detects the change and transmits such signal to the central processing member 70, which will be explained later.

Similarly, when the amount of ink (the level of ink liquid surface) in the sub-tanks 29-36 conforms with the position (height) where the second electrode 52 is disposed, a electronic resistance value between a pair of the first electrode 52 changes, and the ink surface level determination device 55 detects the change and transmits such signal to the central processing member 70.

Moreover, as shown in FIG. 6, in addition to the first electrode 51 and the second electrode 52, a third electrode 53 (in this configuration the electrode constitutes a pair) is disposed at the position (height) which internally divides a space between the first electrode 51 and the second electrode 52 by the mixing ratio of ink to be mixed.

Furthermore, the first electrode 51, the second electrode 52 and the third electrode 53 are arranged in the height-wise direction in the sub-tanks 33-36 containing the mixture of colors, and the position (height) is set so that the ratio of volume occupied by each spaces between the electrode 51 and the electrode 52 and the electrode 53 is equivalent to the ratio of ink to be mixed.

More specifically, it is set so that the volume ratio of space A between the first electrode 51 and the second electrode 52 and space B between the second electrode 52 and the third electrode 58 is equivalent to the mixing ratio of basic ink to be replenished and supplied to the mixed color sub-tanks. Consequently, the volume of space A and B, that is, the position (height) of the third electrode 53, differs by the mixing ratio of basic ink to be replenished and supplied in each sub-tanks 33-36.

Meanwhile, the tank shown in FIG. 6 has only a third electrode 53 since it is the mixed color sub-tank 33-35 which mixes two colors of basic ink. A fourth electrode 54 (in this configuration the electrode is a pair of electrodes) is disposed on the mixed sub-tank 36, as shown in FIG. 7, where three colors of basic ink are mixed.

Moreover, the third electrode 53 and the fourth electrode 54 are set so that the distances between the first electrode 51 and the fourth electrode 54, between the fourth electrode 54 and the third electrode 53, and between the third electrode 53 and the second electrode 52 become the mixing ratio of three colors of basic ink.

2.5 Conveyance Mechanism for Recording Paper

As shown in FIGS. 2 and 3, in the upstream side of the image recording unit 23, a driving roller 60 and a retaining roller 61 are provided. The driving roller 60 and the retaining roller 61 sandwich the recording paper 47 conveyed in the conveyance path 22, and feed the recording paper 47 onto the platen 41. The driving roller 60 is driven and rotated by a motor 64.

On the other hand, in the downstream side of the image recording unit 23, a paper discharge roller 62 and a retaining roller 63 are disposed. The paper discharge roller 62 and the retaining roller 63 sandwich the recording paper 47 on which image recording is finished, and feed the recording paper 47. The paper discharge roller 62 is driven and rotated by a motor (not shown) which is similar to the motor 64 for the driving roller 60.

The retaining roller 61 is resiliently pressed against the driving roller 60 so that the retaining roller 61 presses the driving roller 60 with predetermined pressing force. When the recording paper 47 enters between the driving roller 60 and the retaining roller 61, the retaining roller 61 resiliently recedes by the thickness of the recording paper 47 and holds the recording paper 47 together with the driving roller 60.

Similarly, the retaining roller 63 is resiliently pressed against the paper discharge roller 62. However, since the retaining roller 63 comes in contact with the recording paper 47 on which image recording is finished, the surface of the retaining roller 63 is formed spur-like, in order not to deteriorate the image recorded on the recording paper 47.

The recording paper 47, held by the driving roller 60 and the retaining roller 61, is intermittently fed in predetermined linefeed widths on the platen 41. Correspondingly, the recording head 43 is moved (in this configuration it is moved in parallel) every time the recording paper 47 is fed for a new line, and performs image recording from the leading end side of the recording paper 47. The recording paper 47, wherein image recording is finished, is discharged onto the paper discharge tray 15.

3. Electrical Structure of Multifunction Apparatus 10

Figure 9:
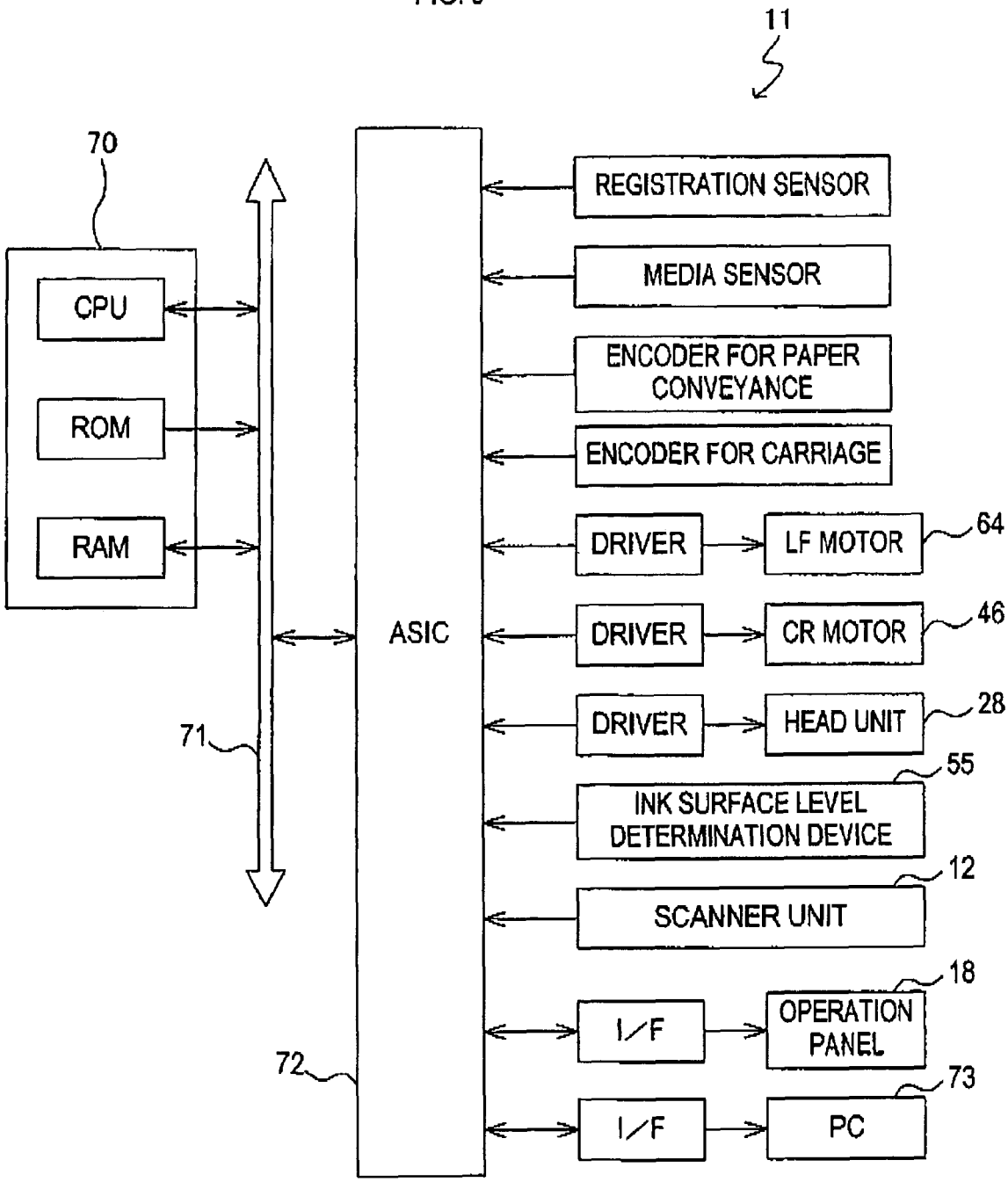
FIG. 9 is a diagram showing an electrical structure of the inkjet recording apparatus according to an embodiment of the present invention.
Figure 10:
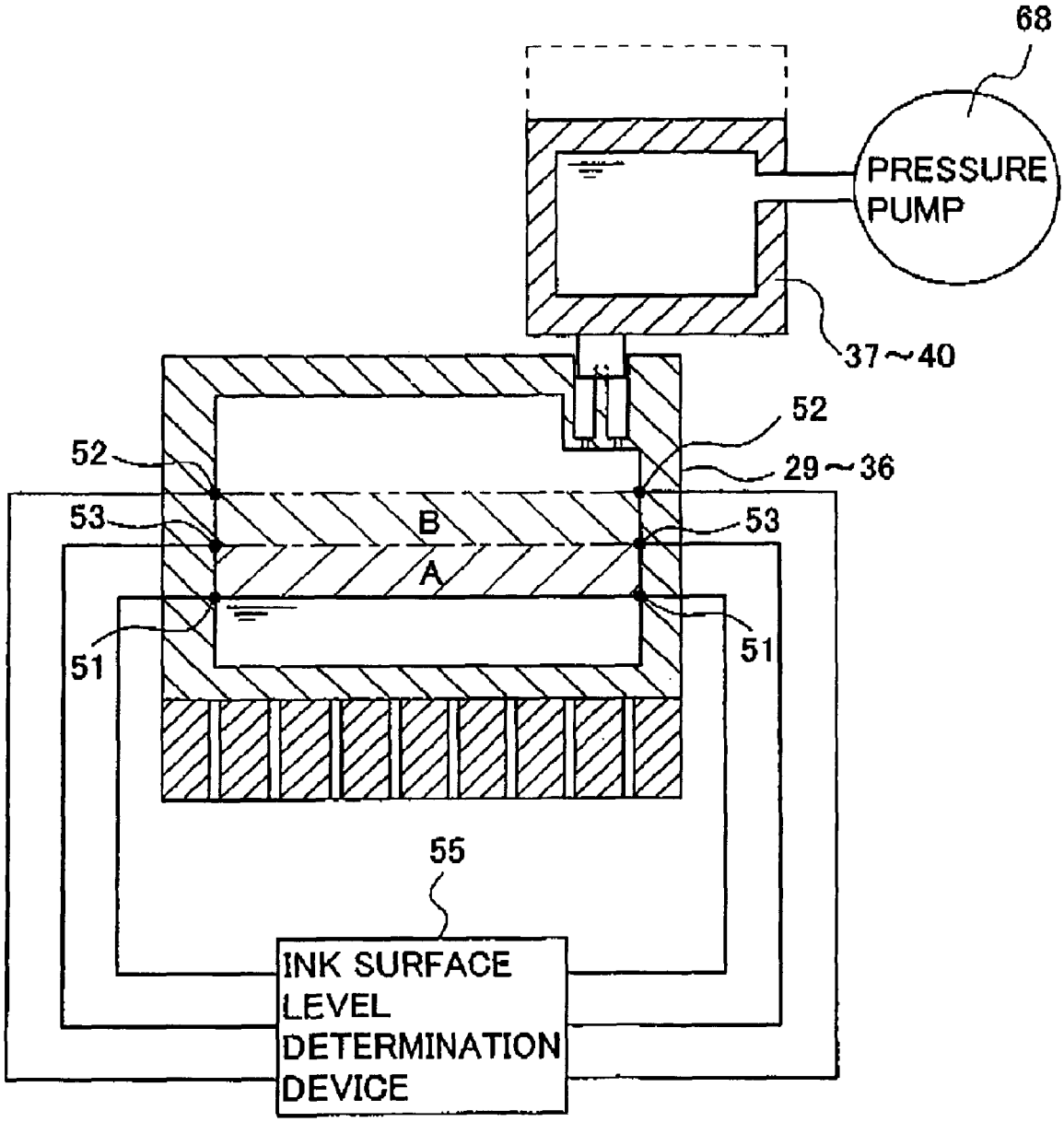
FIG. 10 is a diagram showing an ink replenishment state in the inkjet recording apparatus according to an embodiment of the present invention.

Referring now to FIG. 9, a control device of the multifunction apparatus 10 according to one embodiment of the present invention is a micro computer having a central processing unit 70 with a CPU, a ROM, and a RAM. The central processing unit 70 is connected to various sensors, the printer unit 11, the scanner unit 12, the operation panel 18, and so forth via a bus 71 and an ASIC (Application Specific Integrated Circuit) 72 so as to be able to transmit/receive data to/from these components.

The ROM provided in the central processing unit 70, stores predetermined computer programs. In accordance with the programs stored in the ROM and based on information from various sensors and signals from the liquid surface level determination device 55, the CPU performs some control processes. Specifically, the CPU controls the rotation of the motor 64 (LF motor), which is the driving source of the driving roller 60, and the rotation of the belt driving motor 46 (CR motor) so as to make the head portion 28 slide. The CPU also controls the extension and contraction of the slide cylinder 67 so as to move the ink tanks 37-40 toward the head portion 28, and controls the pump 68 so as to supply the basic ink stored in the ink tanks 37-40 into the sub-tanks 29-36.

The multifunction apparatus 10 according to one embodiment of the present invention includes an interface (I/F) for transmitting/receiving data to/from a personal computer (PC) 73. When the I/F is connected to the PC 73, a graphic image or a text image can be recorded on the recording paper 47 based on graphic data or text data transmitted from the PC 73.

4. Operation of Printer Unit 11 (Inkjet Recording Apparatus)

The printer unit 11 (inkjet recording apparatus) according to one embodiment of the present invention is different from a general inkjet recording apparatus in terms of the structure and the operation for replenishing and supplying ink from the ink tanks 37-40 into the sub-tanks 29-36. The following describes the operation of the printer unit 11 (inkjet recording apparatus) focusing especially on the ink replenishment operation.

4.1 Overall Operation of Ink Replenishment

Firstly, the scanning carriage 42 is moved so that the sub-tanks 29-36, which receive ink supply from the sub-tanks 37-40, are positioned immediately below the ink tanks 37-40 which store specific colors to supply.

Next, the slide cylinders 67 are extended so as to lower the ink tanks 37-40 toward the sub-tanks 29-36. The connecting portions 66 of the ink tanks 37-40 are inserted into the supply openings 50 of the sub-tanks 29-36 and connected thereto.

At this time, the on-off valves 58 pressed by the push rods 50*a* and open the ink replenishment openings 66*a* (see FIG. 8B). The pumps 68 are operated so as to supply ink inside of the ink tanks 37-40 into the sub-tanks 29-36.

In the mixed color sub-tanks 33-36, mixed inks: ink B, ink R, ink G, and ink Pb are respectively stored. Ink B is produced with ink C and ink M mixed together. Ink R is produced with ink Y and ink M mixed together. Ink G is produced with ink Y and ink C mixed together. Ink Pb is produced with ink Y, ink M, and ink C mixed together.

4.2 Ink Replenishment Operation Control

Figure 11:
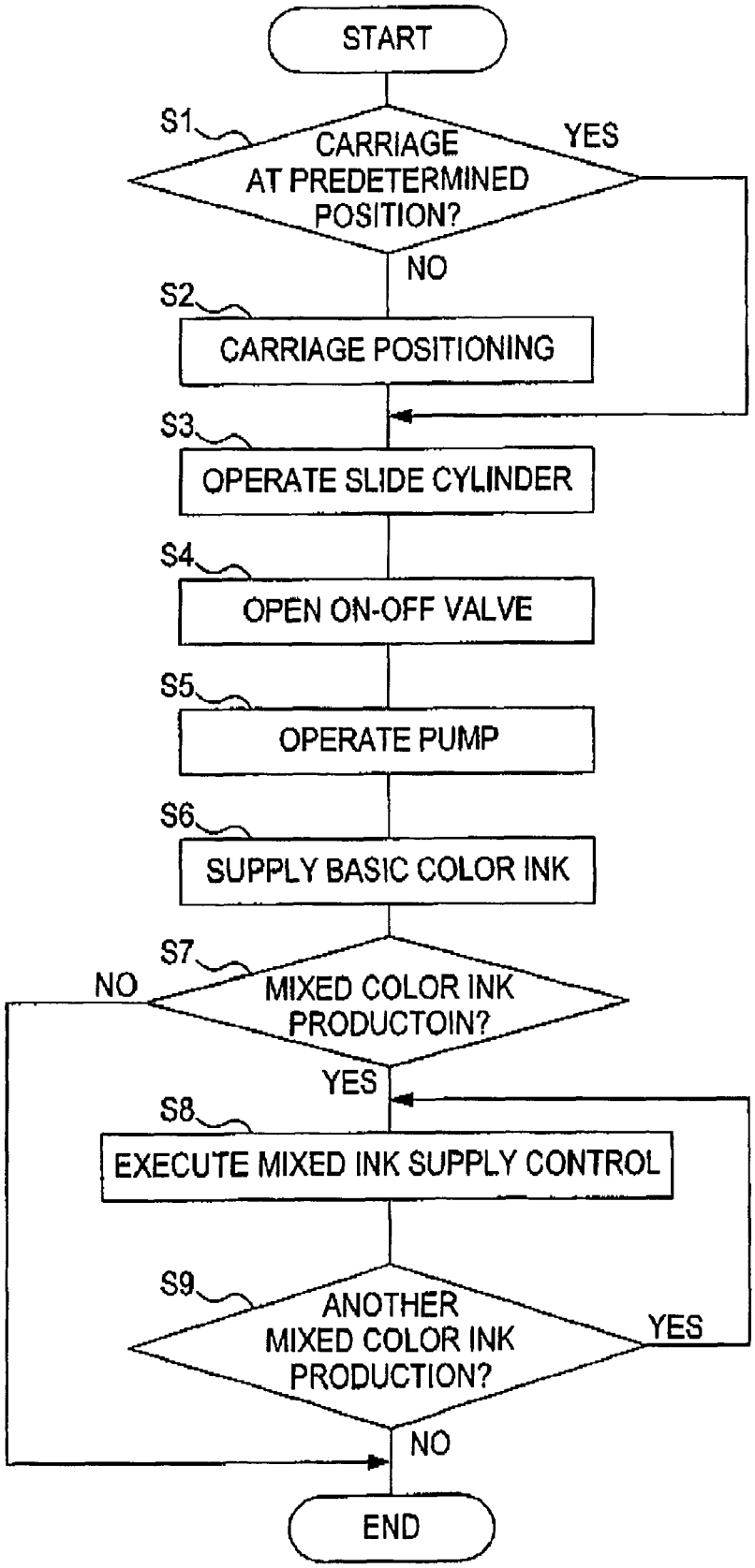
FIG. 11 is a flowchart illustrating the ink replenishment operation of the inkjet recording apparatus according to an embodiment of the present invention.

FIG. 11 is a flowchart showing the above-described replenishment operation, wherein the basic ink is replenished from the ink tanks 37-40 into the sub-tanks 29-36. The replenishment operation is carried out when the remaining ink in the sub-tanks 29-36 reaches the predetermined minimum amount based on a signal from one of the electrodes 51-54 (in this configuration the signal is from electrode 51). Hereinafter, this flowchart will be explained in detail.

Firstly, the basic inks are supplied from the ink tanks 37-40 into respective basic color sub-tanks 29-32. Specifically, in S1, it is determined whether or not the scanning carriage 42 of the head unit 28 is positioned at a predetermined position, that is, at an end of a scannable area where the scanning carriage 42 can perform scanning. This determination is made, for example, based on an input signal from a position sensor for the scanning carriage 42, such as an encoder.

If it is determined that the scanning carriage 42 is not positioned at the predetermined position (S1:NO), in S2, the belt drive motor 46 is driven so as to move the scanning carriage 42 to the predetermined position. In S3, the slide cylinders 67 are operated. In S4, the connecting portions 66 of respective ink tanks 37-40 and the supply openings 50 of the sub-tanks 29-32 are connected, so that the on-off valves 58 of the connecting portions 66 open the ink replenishment openings 66. In S5, the pumps 68 are operated. As a result, in S6, the basic inks are independently supplied into respective sub-tanks 29-32.

If it is determined that the scanning carriage 42 is positioned at the predetermined position (S1:YES), the process in S2 is skipped and the process in S3 is executed. Subsequently, it is determined whether or not production of mixed ink is necessary, in other words, the remaining ink in the mixed color sub-tanks 33-36 becomes the predetermined minimum amount (S7). Then, if it is determined that production of mixed ink is necessary (S7:YES), the mixed color ink supply control which will be discussed later, is executed (S8).

Subsequently, in S9, it is determined whether or not production of another mixed ink is necessary. If it is determined that production of another mixed ink is necessary (S9:YES), S8 is executed. On the other hand, if it is determined that production of another mixed ink is not necessary (S9:NO), the flow of the present control finishes.

4.2.1.2 Mixed Ink Supply Control for Mixing Two Colors

Figure 12:
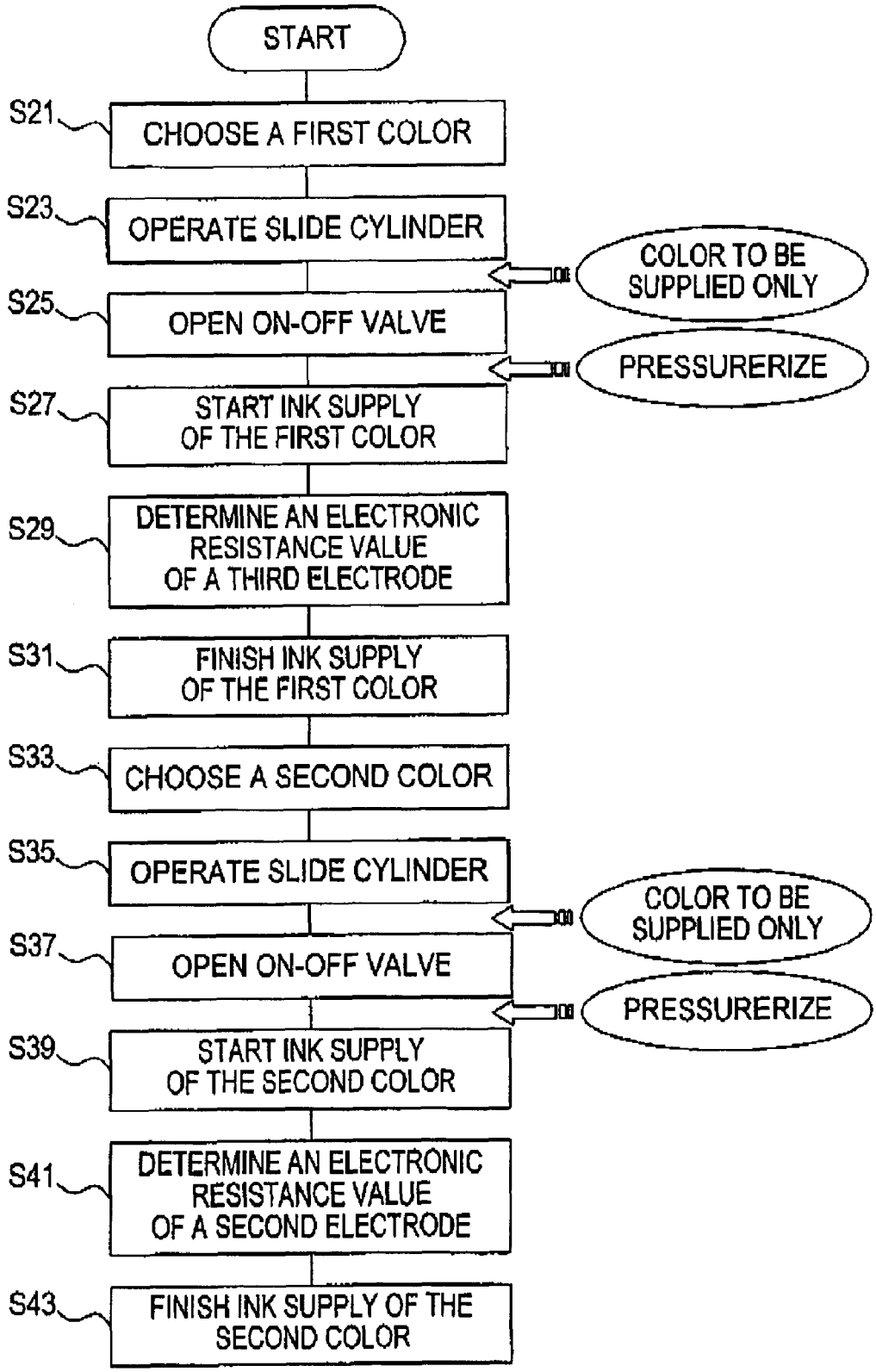
FIG. 12 is a flowchart illustrating an ink replenishment operation of the inkjet recording apparatus according to the embodiment.

FIG. 12 is a control flowchart showing a mixed ink supply control when two colors of basic ink are mixed. First, the scanning carriage 42 is scanned so as to position one of the mixed sub-tanks 33-36, subject to replenishment, immediately below one of the ink tanks 37-40, which store basic ink to replenish and supply as a first color (S21).

When scanning by the scanning carriage 42 is done, the slide cylinder 67 is operated (S23). Then, the connecting portion 66 of the ink tank and the supply opening 50 of the sub-tank are connected, and the on-off valve 58 of the connecting portion 66 is opened (S25). Subsequently, the pump 68 is operated, and supply of the first basic ink to the sub-tank is initiated (S27). It is desirable that the speed of replenishment should be regulated so that the ink liquid surface does not ruffle within the sub-tank when the basic ink is replenished.

Then, based on a signal from the third electrode 53, it is determined whether or not the basic ink, which is in the process of replenishment, is reached the predetermined amount (S29). When it is determined that the amount of replenishment is reached the predetermined amount, the pump 68 is stopped and replenishment of the first basic ink finishes (S31).

Next, the scanning carriage 42 is scanned so as to position one of the mixed sub-tanks 33-36, subject to replenishment, immediately below one of the ink tanks 37-40, which store a basic ink to replenish (supply) as a second color (S33).

When scanning by the scanning carriage 42 is done, the slide cylinder 67 is operated (S35). Then, the connecting portion 66 of the ink tank and the supply opening 50 of the sub-tank are connected, and the on-off valve 58 of the connecting portion 66 is opened (S37). Subsequently, the pump 68 is operated, and supply of the second basic ink to the sub-tank is initiated (S39).

Then, based on a signal from the second electrode 52, it is determined whether or not the basic ink, which is in the process of replenishment, is reached the predetermined amount (S41). When it is determined that the replenishment amount is reached the predetermined amount, the pump 68 is stopped and replenishment of the second basic ink finishes (S43).

4.2.2.3 Mixed Ink Supply Control for Mixing Three Colors

Figure 13:
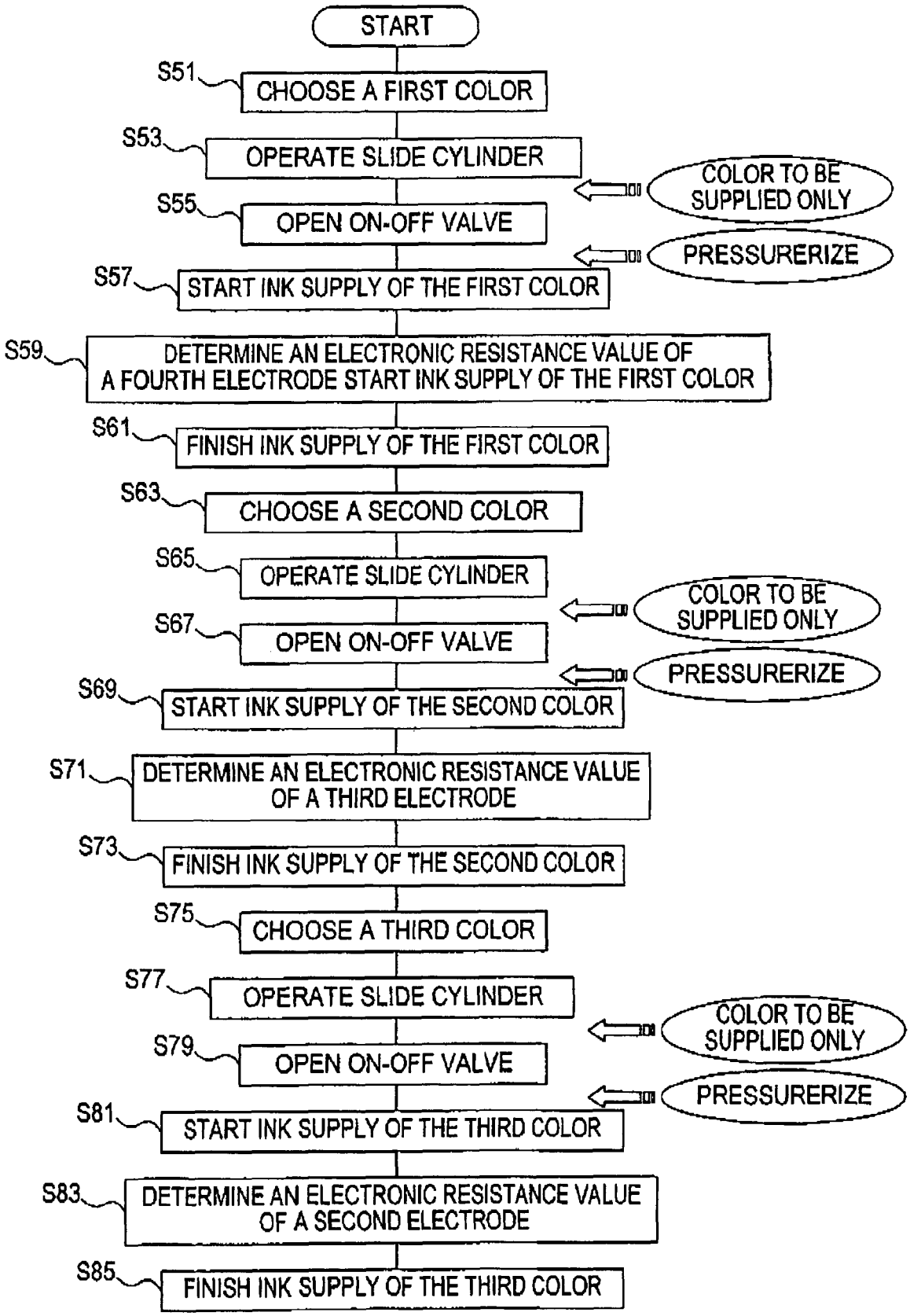
FIG. 13 is a flowchart illustrating the ink replenishment operation of the inkjet recording apparatus according to an embodiment of the present invention.

FIG. 13 is a control flowchart showing a mixed ink supply control when three colors of basic ink are mixed. First, the scanning carriage 42 is scanned so as to position one of the mixed sub-tanks 33-36, subject to replenishment, immediately below one of the ink tanks 37-40, which store a basic ink to replenish (supply) as a first color (S51).

When scanning by the scanning carriage 42 is done, the slide cylinder 67 is operated (S53). Then, the connecting portion 66 of the ink tank and the supply opening 50 of the sub-tank are connected, and the on-off valve 58 of the connecting portion 66 is opened (S55). Subsequently, the pump 68 is operated, and supply of the first basic ink to the sub-tank is initiated (S57).

Then, based on a signal from the fourth electrode 54, it is determined whether or not the basic ink, which is in the process of replenishment, is reached the predetermined amount (S59). When it is determined that the replenishment amount is reached the predetermined amount, the pump 68 is stopped and replenishment of the first basic ink finishes (S61).

Next, the scanning carriage 42 is scanned so as to position one of the mixed sub-tanks 33-36, subject to replenishment, immediately below one of the ink tanks 37-40, which store a basic ink to replenish (supply) as a second color (S63).

When scanning by the scanning carriage 42 is done, the slide cylinder 67 is operated (S65). Then, the connecting portion 66 of the ink tank and the supply opening 50 of the sub-tank are connected, and the on-off valve 58 of the connecting portion 66 is opened (S67). Subsequently, the pump 68 is operated, and supply of the second basic ink to the sub-tank is initiated (S69).

Then, based on a signal from the third electrode 53, it is determined whether or not the basic ink, which is in the process of replenishment, is reached the predetermined amount (S71). When it is determined that the replenishment amount is reached the predetermined amount, the pump 68 is stopped and replenishment of the second basic ink finishes (S73).

Next, the scanning carriage 42 is scanned so as to position one of the mixed sub-tanks 33-36, subject to replenishment, immediately below one of the ink tanks 37-40, which store a basic ink to replenish (supply) as a third color (S75).

When scanning by the scanning carriage 42 is done, the slide cylinder 67 is operated (S77). Then, the connecting portion 66 of the ink tank and the supply opening 50 of the sub-tank are connected, and the on-off valve 58 of the connecting portion 66 is opened (S79). Subsequently, the pump 68 is operated, and supply of the third basic ink to the sub-tank is initiated (S81).

Then, based on a signal from the second electrode 52, it is determined whether or not the basic ink, which is in the process of replenishment, is reached the predetermined amount (S83). When it is determined that the amount of replenishment is reached the predetermined amount, the pump 68 is stopped and replenishment of the second basic ink finishes (S85).

4.3 Detail of Ink Replenishment Operation 4.3.1 Basic Ink Replenishment

Figure 14:
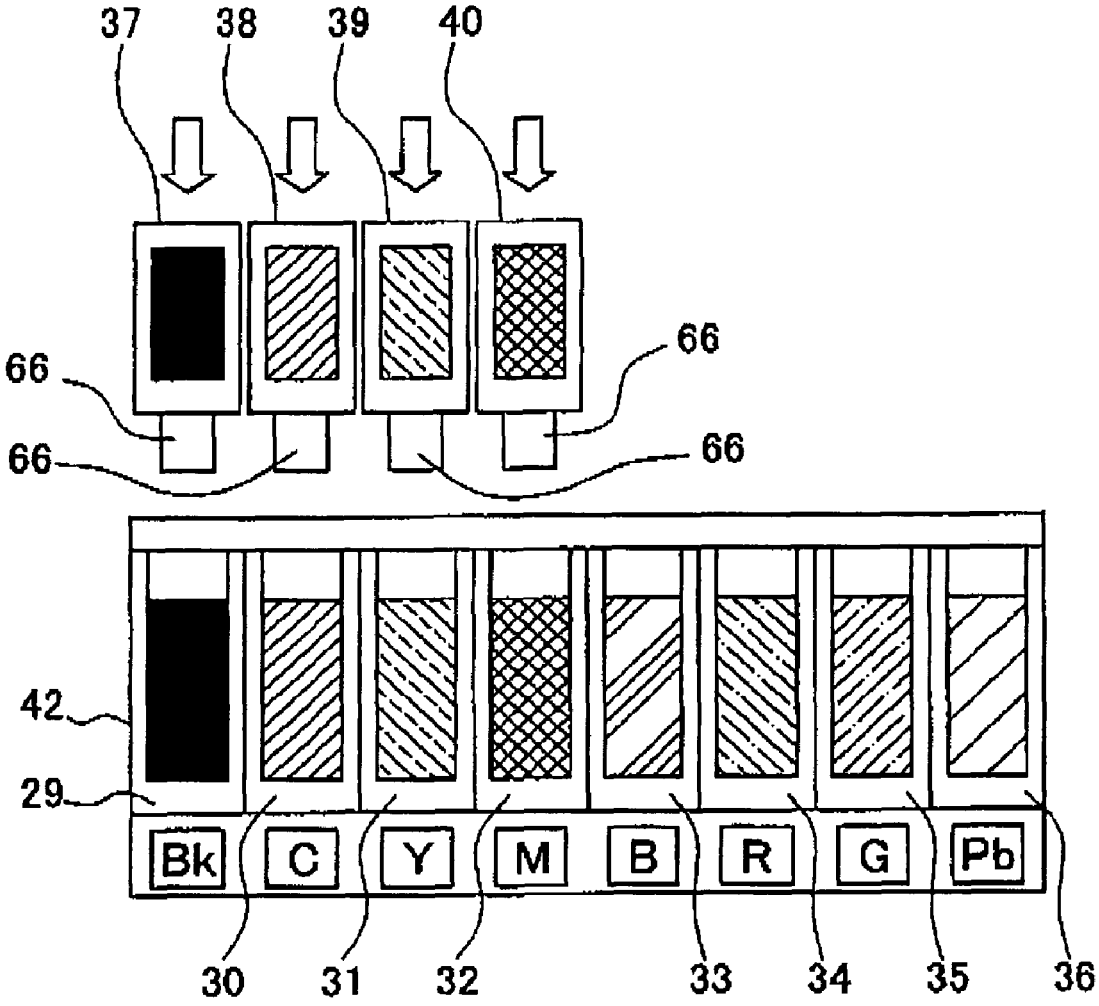
FIG. 14 is a diagram showing the ink replenishment operation of the inkjet recording apparatus according to an embodiment of the present invention.

In accordance with the processes in S2 to S6 of the ink replenishment operation control (see FIG. 11), the scanning carriage 42 is positioned, and respective ink tanks 37-40 are connected to the sub-tanks 29-32, as shown in FIG. 14.

At this time, upon the connecting portions 66 of respective ink tanks 37-40 being inserted into the supply openings 50 of the sub-tanks 29-32, the pumps 68 are operated and the basic inks are respectively supplied into the sub-tanks 29-32.

4.3.2 Production of Mixed Ink (ink B)

Ink B is produced with, among the basic inks, ink C and ink M mixed together. Firstly, as shown in FIG. 15A, the ink tank 38 is positioned immediately above the sub-tank 33 which is allocated for producing mixed ink (ink B). The ink tank 38 is lowered so as to be connected to the sub-tank 33. Then, ink C is supplied into the sub-tank 33.

Figure 15B:
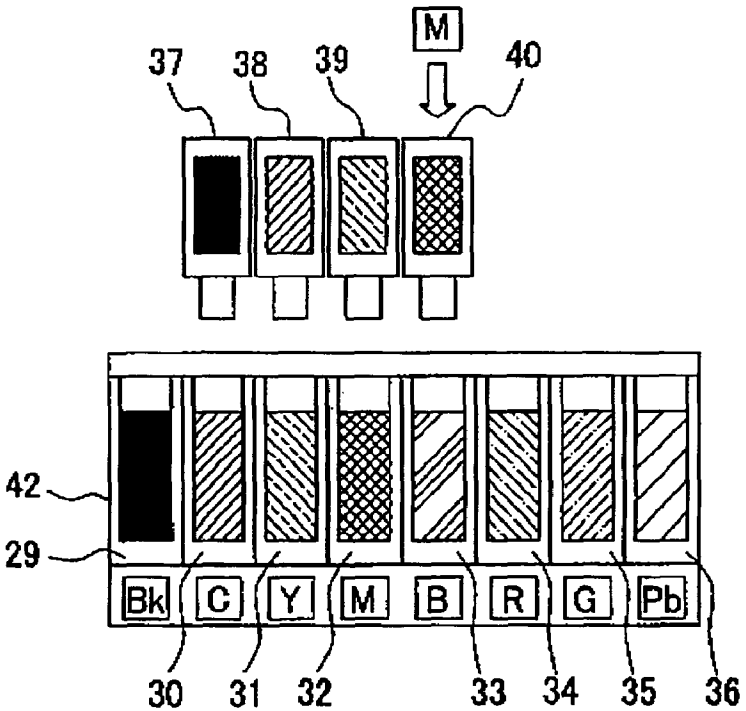
FIGS. 15A and 15B are diagrams showing the ink replenishment operation of the inkjet recording apparatus according to an embodiment of the present invention.
Figure 15A:
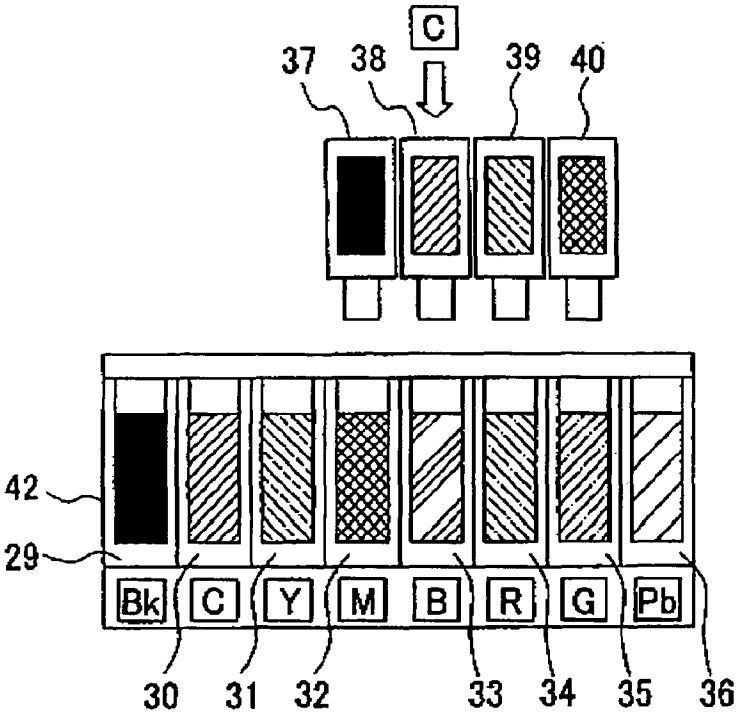

Secondly, as shown in FIG. 15B, the ink tank 40 is positioned immediately above the sub-tank 33. The ink tank 40 is lowered so as to be connected to the sub-tank 33. Then, ink M is supplied into the sub-tank 33. As a result, ink B is produced in the sub-tank 33.

The way of producing ink B is not limited to the above-described example. Contrary to the order of ink supply in the above example, ink M can be firstly supplied into the sub-tank 33, and then ink C can be supplied. In other words, among the plurality of the basic inks to be mixed, inks should be preferably supplied into the sub-tank 33 in the order from a relatively paler color.

4.3.3 Mixed Ink (Ink R)

Ink R is produced with, among the basic inks, ink Y and ink M mixed together. Firstly, as shown in FIG. 16A, the ink tank 39 is positioned immediately above the sub-tank 34 which is allocated for producing mixed ink (ink R). The ink tank 39 is lowered so as to be connected to the sub-tank 34. Then, ink Y is supplied into the sub-tank 34.

Figure 16B:
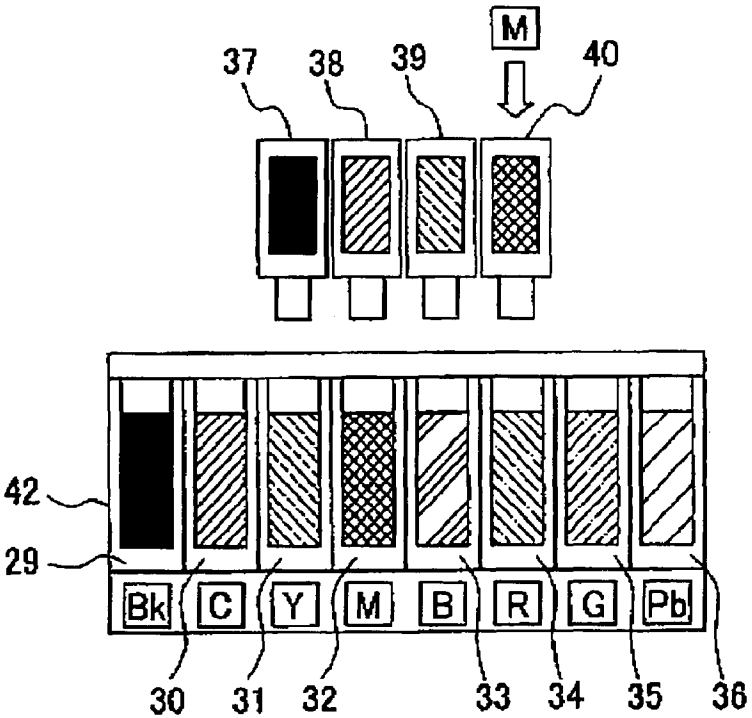
FIGS. 16A and 16B are diagrams showing the ink replenishment operation of the inkjet recording apparatus according to an embodiment of the present invention.
Figure 16A:
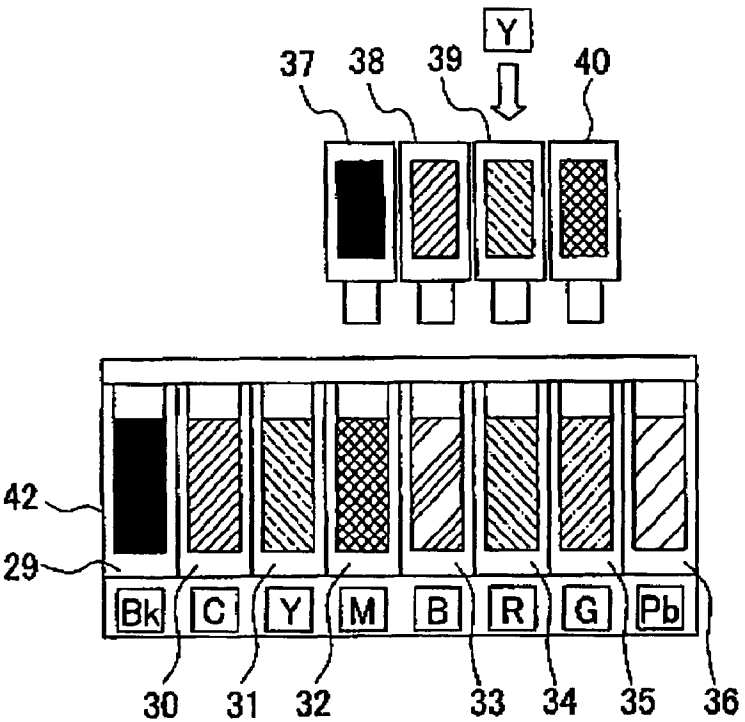

Secondly, as shown in FIG. 16B, the ink tank 40 is positioned immediately above the sub-tank 34. The ink tank 40 is lowered so as to be connected to the sub-tank 34. Then, ink M is supplied into the sub-tank 34. As a result, ink R is produced in the sub-tank 34.

The way of producing ink R is not limited to the above-described example. Contrary to the order of ink supply in the above example, ink Y can be firstly supplied into the sub-tank 34, and then ink M can be supplied.

4.3.4 Mixed Ink (Ink G)

Ink G is produced with, among the basic inks, ink Y and ink C mixed together. Firstly, as shown in FIG. 17A, the ink tank 39 is positioned immediately above the sub-tank 35 which is allocated for producing mixed ink (ink G). The ink tank 39 is lowered so as to be connected to the sub-tank 35. Then, ink Y is supplied into the sub-tank 35.

Figure 17B:
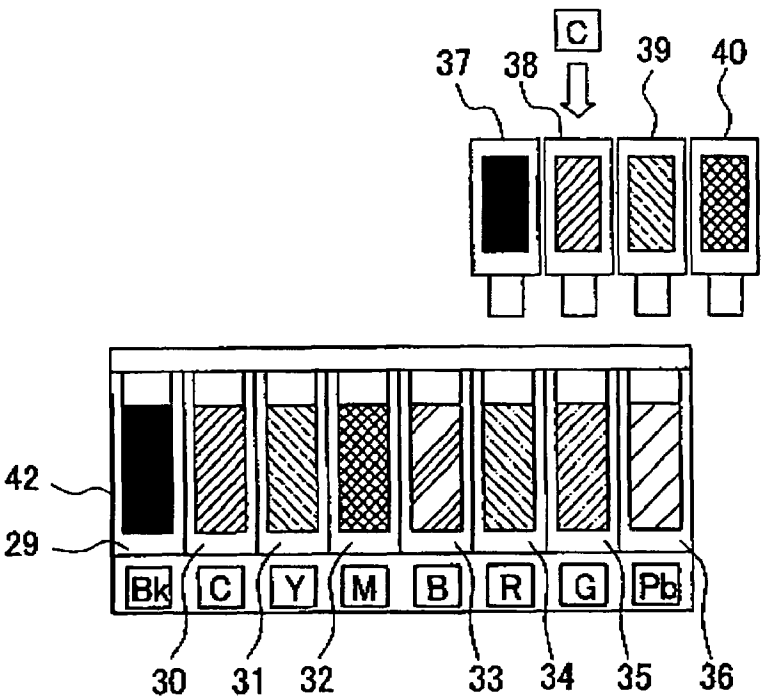
FIGS. 17A and 17B are diagrams showing the ink replenishment operation of the inkjet recording apparatus according to an embodiment of the present invention.
Figure 17A:
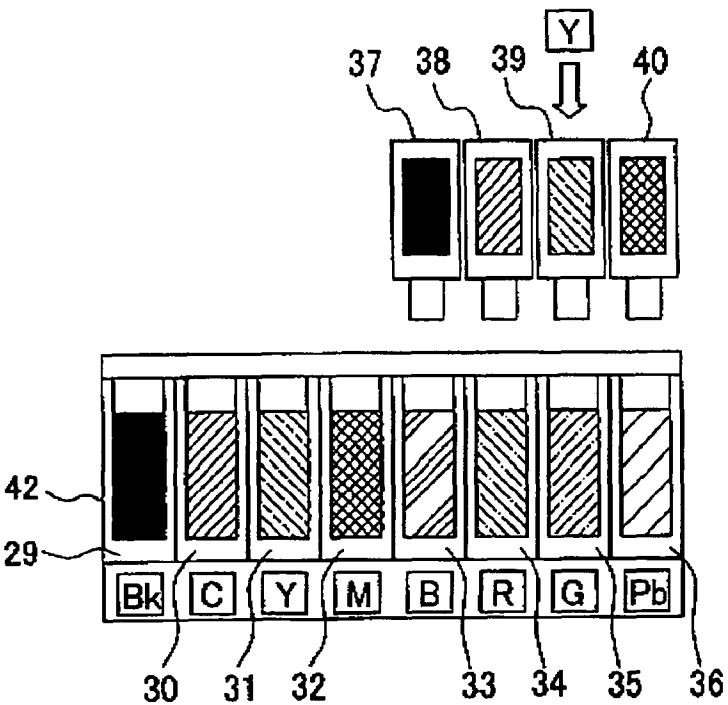

Secondly, as shown in FIG. 17B, the ink tank 38 is positioned immediately above the sub-tank 35. The ink tank 38 is lowered so as to be connected to the sub-tank 35. Then, ink C is supplied into the sub-tank 35. As a result, ink G is produced in the sub-tank 35.

The way of producing ink G is not limited to the above-described example. Contrary to the order of ink supply in the above example, ink Y can be firstly supplied into the sub-tank 35, and then ink C can be supplied.

4.3.5 Mixed Ink (Ink Pb)

Figures 18A, 18B, 18C:
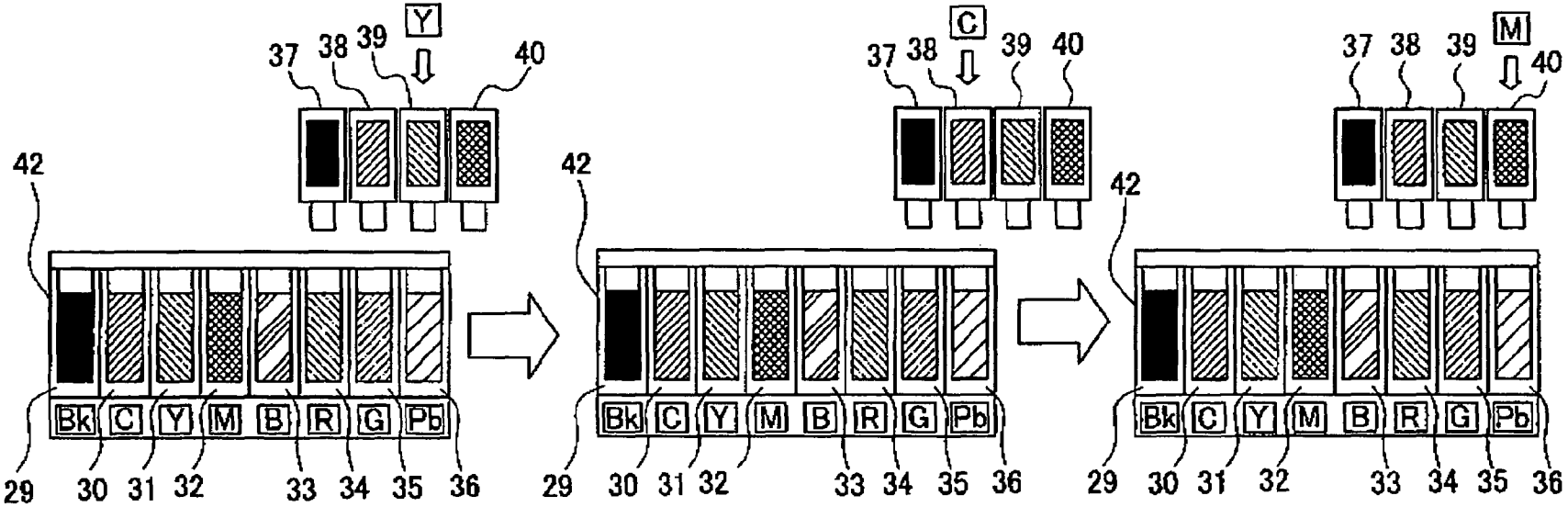
FIGS. 18A, 18B and 18C are diagrams showing the ink replenishment operation of the inkjet recording apparatus according to an embodiment of the present invention; and, FIG. 19 is a diagram showing a structure of an ink tank according to a variation of the present invention.

Ink Pb is produced with three colors of inks among the basic inks, that is, ink Y, ink C, and ink M mixed together. Firstly, as shown in FIG. 18A, the ink tank 39 is positioned immediately above the sub-tank 36 which is allocated for producing mixed ink (ink Pb). The ink tank 39 is lowered so as to be connected to the sub-tank 36. Then, ink Y is supplied into the sub-tank 36.

Secondly, as shown in FIG. 18B, the ink tank 38 is positioned immediately above the sub-tank 36. The ink tank 38 is lowered so as to be connected to the sub-tank 36. Then, ink C is supplied into the sub-tank 36.

Furthermore, as shown in FIG. 18C, the ink tank 40 is positioned immediately above the sub-tank 36. The ink tank 40 is lowered so as to be connected to the sub-tank 36. Then, ink M is supplied into the sub-tank 36. As a result, ink Pb is produced in the sub-tank 36.

The way of producing ink Pb is not limited to the above-described example. The inks can be supplied into the sub-tank 36, for example, in the order from a relatively paler color, that is, in the order of ink Y, ink M, and ink C.

In the above-described embodiments, the replenishment amount device includes a first electrode 51 to the fourth electrode 54 and the liquid surface level determination device 55. However, the present invention is not limited to this embodiment. The replenishment amount device can include devices for measuring the amount of ink existing in the mixed color sub-tanks 33-36 or of detecting the ink liquid surface optically and so forth.

Although the connecting portions 66 are disposed in the lower portion of the ink tanks 37-40 and the supply holes 50 are disposed in the upper portion of the sub-tanks 29-36 in the first embodiment described above, it is not limited to this embodiment. According to the co-pending application Ser. No. 11/386,095 incorporated in the present application, the connecting portions (66) can be disposed in the side surface of the ink tank and the mating portions (56) can be disposed in the side surface of the sub-tank. All the disclosure of the co-pending application Ser. No. 11/386,095 is incorporated herein by reference.

5. Characteristic of Inkjet Recording Apparatus (Printer Unit 11)

In the embodiment of the present invention, related to the multifunction apparatus (Inkjet recording apparatus), replenishment of the plurality of colors of basic ink is carried out as it automatically detects the replenishment amount of each of the plurality of colors of basic ink to be replenished to the sub-tanks 33-36, the accurate mixing ratio of mixed ink of the sub-tanks 33-36 can be replicated.

Furthermore, in the present embodiment, the replenishment amount is detected by utilizing a change of the electronic resistance value. Therefore, the replenishment amount can be detected more easily, accurately and inexpensively.

Second Embodiment

In the first embodiment, the ink tanks 37-40 and the sub-tanks 33-36 are usually separated from each other, and they become connected each other when ink is supplied from the ink tanks to the sub-tanks. However, in the second embodiment, as it is described in the co-pending application Ser. No. 11/386,930, the ink tanks and the sub-tanks are usually connected each other via the connecting pipes and the ink replenishment from the ink tanks to the sub-tanks is performed by a pump disposed in the ink tank, and switching valve between the pump and the ink tanks and switch valves disposed in the sub-tanks.

The detailed explanation would be referred to the co-pending application Ser. No, 11/385,930, all the disclosure of which is incorporated herein by reference.

As described in the first embodiment, the sub-tanks are provided with electrodes in order to supply the predetermined amount of ink from the ink tanks 37-40 to the sub-tanks 29-36 and replenishment of ink is controlled based on the signal from the electrodes that are applied to the inkjet recording apparatus of the second embodiment, That is, as shown in FIGS. 5, 6 and 7, the sub-tanks are provided with the electrode 51 to measure the minimum amount of ink and the electrode 52 to detect the maximum amount of ink as well. Also, the sub-tanks that store the mixed ink are provided with the electrodes 53-54 at the level in accordance with the mixing ratio of the plurality of basic inks in order to make the mixed ink, and the predetermined ink is replenished by detecting the signal from the electrode, more specifically, the change of the resistance value between the pair of electrodes.

According to the co-pending Ser. No. 11/385,930, as shown in FIGS. 9A and 9B, FIGS. 10A and 10B and FIGS. 11A and 11B (FIGS. 9A and 9B: Steps 4 to 6, FIGS. 10A and 10B: Steps 4 to 6 and Steps 10 to 12, FIGS. 11A and 11B: Steps 4 to 6, Steps 10 to 12 and Steps 16 to 18), the predetermined amount of ink is supplied by the pressurizing pump being operated in the predetermined period of time. However, in the second embodiment of the present invention, operation of the pressure pump stops when it is determined that the predetermined amount of ink is replenished based on the change of the resistance value between the pair of electrodes.

Therefore, according to the second embodiment above, the mixed ink can be supplied stably and accurately as well as the first embodiment.

There are two kinds of sub-tanks of the co-pending application Ser. No. 11/386,095 and the Ser. No. 11/385,930: one is to store the basic inks and the other is to store the mixed inks. It should be noted that a number of all the sub-tanks is represented as m in the Ser. No. 11/386,095, whereas the number of the sub-tanks is represented as n+m in the Ser. No. 11/385,930; therefore, the meaning of 'm' is different in those applications. In order to avoid confusion, the number of the sub-tanks is indicated as n' and the number of the sub-tanks that store the mixed liquid is indicated as n".

Figure 19:
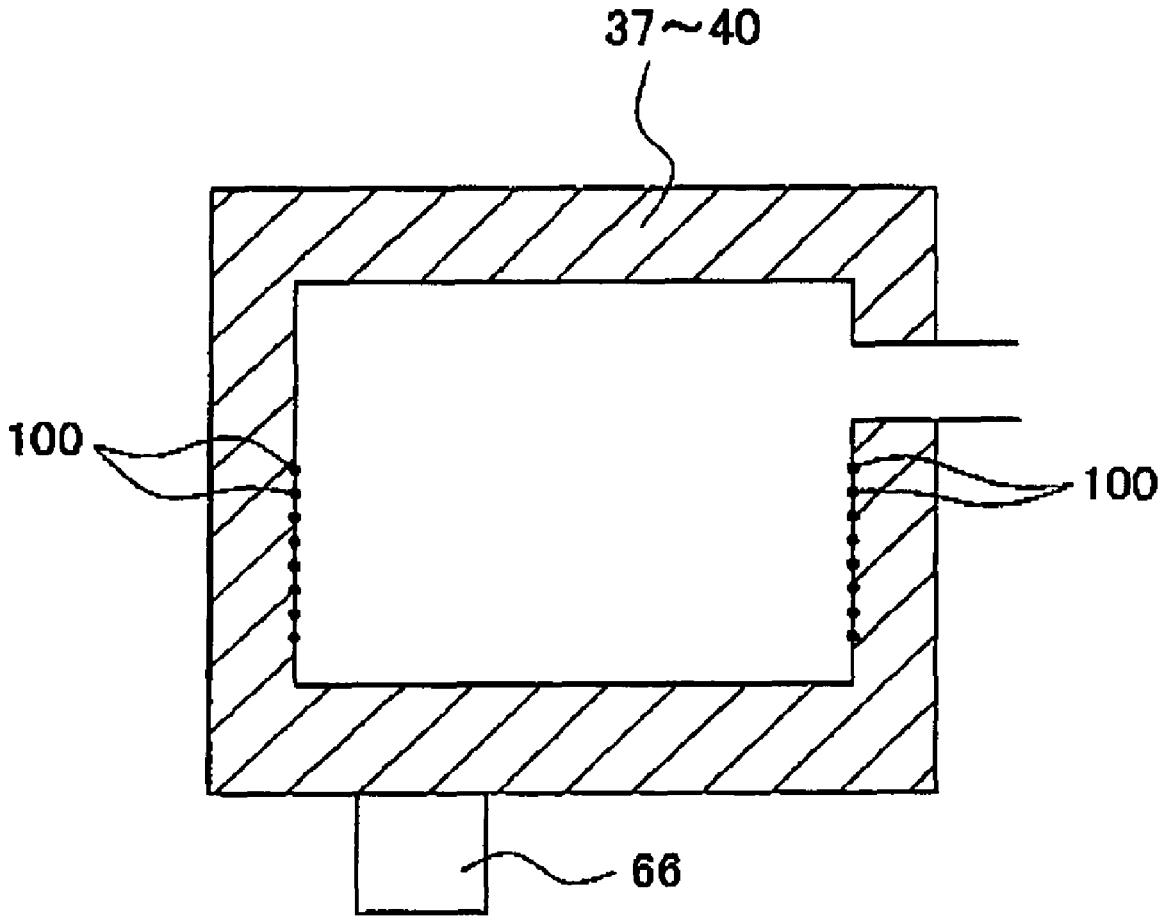

In the first and second embodiments, the detector that detects the amount of ink is disposed in the sub-tanks, however, it can be disposed in the ink tank too. In this case, the amount of ink to be supplied from the ink tank to the sub-tank differs depending on the mixed color to be made; therefore, the height of the ink should be detected closely. For this purpose, it is desirable that the electrodes 100 are arranged closely each other by uniform intervals in the heightwise direction as shown in FIG. 19, or an optical sensor is employed to measure the liquid surface level (not shown) when the ink amount detector is disposed in the ink tank.

Although the embodiments have been illustrated and described herein, it will be appreciated by those of ordinary skill in the art that any arrangement that is calculated to achieve the same purpose may be substituted for the specific embodiments shown. This application is intended to cover any adaptations or variations of the present invention. It is to be understood that the above description is intended to be illustrative, and not restrictive. Combinations of the above configurations and other configurations will be apparent to those of skill in the art upon reviewing the above description. The scope of the invention includes any other applications in which the above structures and fabrication methods are used. Accordingly, the scope of the invention should only be determined with reference to the appended claims, along with the full scope of equivalents to which such claims are entitled.

What is claimed is:

1. A droplet ejection apparatus comprising:

a plurality of tanks, wherein each of the plurality of tanks are capable of storing a different kind of basic liquid;

a plurality of sub-tanks, including a first sub-tank that includes a mixed liquid of two or more of the different kinds of the basic liquids from the plurality of tanks;

a replenishment amount detector that detects amount of each of the different kinds of the basic liquids to be transferred to the first sub-tank;

a liquid replenisher that transfers the basic liquids stored in the tanks into the sub-tanks until a predetermined amount for each of the basic liquids is detected by the replenishment amount detector; and a recording head ejecting the liquids supplied from the sub-tanks in a form of droplets;

wherein the replenishment amount detector provides a signal based on amount of liquid existing in the first sub-tank;

wherein the replenishment amount detector provides a signal;

wherein at a first detection point, indicating that the liquid amount of the first sub-tank reaches a first amount which requires an operation to start replenishing the basic liquids to the first sub-tank;

wherein at a second detection point, indicating that the liquid amount of the first sub-tank reaches a second amount which does not require replenishing the basic liquids; and wherein at a third detection point, indicating that the liquid amount of the first sub-tank reaches a third amount which is determined by dividing a difference between the first amount and the second amount by a ratio of the basic liquids to be mixed.

2. The droplet ejection apparatus according to claim 1:

wherein the replenishment amount detector provides a signal based on a height of a liquid surface of the liquid existing in the first sub-tank.

3. The droplet ejection apparatus according to claim 2;

wherein the replenishment amount detector includes a plurality of electrodes arranged in a heightwise direction in the first sub-tank.

4. The droplet ejection apparatus according to claim 1, further comprising:

a carriage configured to hold the sub-tanks and the recording head, and configured to move the sub-tanks relative to the tanks to allow liquid from the tanks to be supplied to plural ones of the sub-tanks; and a controller configured to control movement of the carriage and to control which of the basic liquids are supplied from the tanks to the sub-tanks.

5. The droplet ejection apparatus according to claim 4;

wherein the controller controls the supply of the basic liquids from the tanks to the sub-tanks in order from paler liquids to darker liquids.

6. The droplet ejection apparatus according to claim 5;

wherein the tanks and the sub-tanks are each configured in an array, the array pitch of the tanks and the array pitch of the sub-tanks being the same.

7. The droplet ejection apparatus according to claim 4;

wherein each of the tanks has a connecting portion configured to be connected to any of the sub-tanks and a valve provided to the connecting portion configured to prevent the basic liquid from flowing out of the tank, and each of the sub-tanks has a valve-opening portion configured to open the valve when the sub-tank is connected to the connecting portion.

8. The droplet ejection apparatus according to claim 4, including:

n tanks and n' sub-tanks, wherein n'>n.

9. The droplet ejection apparatus according to claim 8:

wherein the sub-tanks include the first sub-tank and a second sub-tank, the second sub-tank is being adopted to store the basic liquids, the number of the second sub-tank being n and the number of the first sub-tank being n'−n (=n").

10. The droplet ejection apparatus according to claim 9;

wherein the controller is configured to control the supply of basic liquids from the n tanks to the n' sub-tanks, and wherein the basic liquids in the n tanks are respectively supplied to the second sub-tanks and a plurality of the basic liquids are supplied from the n tanks to the first sub-tanks.

11. The droplet ejecting apparatus according to claim 9;

wherein the tanks and the second sub-tanks are arranged to allow the n basic liquids to be supplied from tanks to the second sub-tanks concurrently.

12. The droplet ejecting apparatus according to claim 11;

wherein the tanks and the sub-tanks are each configured in an array, the array pitch of the tanks and the array pitch of the sub-tanks being the same.

13. The droplet ejecting apparatus according to claim 4, further including;

a pump for supplying the basic liquids from the tanks to the sub-tanks.

14. The droplet ejection apparatus according to claim 1;

wherein the plurality of tanks are n tanks for storing n basic liquids; and wherein the plurality of sub-tanks include first sub-tanks each holding a mixed liquid made by mixing at least two basic liquids, the number of the plurality of sub-tanks being n', the number of the first sub-tank being n'−n (=n"); and wherein the droplet ejection apparatus further includes:

a pressurizing supply unit that pressurizes the tanks; and a controller that controls the pressurizing supply unit so that at least two basic liquids are individually supplied to each of the first sub-tanks.

15. The droplet ejection apparatus according to claim 14;

wherein the pressurizing supply unit includes one or more liquid distribution pipes, connected to the tanks that distribute the basic liquids individually from the n tanks to the first sub-tanks.

16. The droplet ejection apparatus according to claim 14, further comprising:

one or more liquid distribution pipes, connected to the tanks that distribute the basic liquids individually from the n tanks to the first sub-tanks, the tanks having been pressurized by the pressurizing supply unit.

17. The droplet ejection apparatus according to claim 14, further comprising:

second sub-tanks connected to the tanks, the second sub-tanks receiving the basic liquids, the number of sub-tank being n.

18. The droplet ejection apparatus according to claim 17;

wherein the first sub-tanks are filled with the basic liquids received through the second sub-tanks.

19. The droplet ejection apparatus according to claim 17;

wherein the second sub-tanks are held in a scanning carriage; and wherein the tanks are connected to the second sub-tanks by pliable tubes that allow relative movement of the second sub-tanks with respect to the tanks.

20. The droplet ejection apparatus according to claim 14, further comprising:

opening/closing valves, one connected to each of the first sub-tanks, that control the receipt of the basic liquids.

21. The droplet ejection apparatus according to claim 20;

wherein each of the opening/closing valves is an open/closed switch valve.

22. The droplet ejection apparatus according to claim 21;

wherein the opening of the open/close switch valve for the respective second sub-tank or first sub-tank allows liquid to flow from one of the tanks into the second sub-tank or from the second sub-tank into the first sub-tank by releasing a pressure arising in the respective second sub-tank or first sub-tank.

23. The droplet ejection apparatus according to claim 14;

wherein the first sub-tanks are held in a scanning carriage together with a recording head.

24. The droplet ejection apparatus according to claim 14;

wherein the pressurizing supply unit includes a pressurizing pump for creating a liquid supply pressure to be applied to the tanks; and wherein a supply pressure switching unit, interposed between the pressurizing pump and the tanks, the supply pressure switching unit applying the liquid supply pressure to at least one of the tanks.

25. The droplet ejection apparatus according to claim 14;

wherein n<n".

26. The droplet ejection apparatus according to claim 1; further comprising:

at least one second sub-tank that stores the basic liquid, which is supplied from at least one of the tanks, without being mixed.

27. The droplet ejection apparatus according to claim 1;

wherein each liquid has a different color.

28. An inkjet recording apparatus comprising the droplet ejection apparatus according to claim 1;

wherein the liquid is ink and the droplet ejection apparatus ejects ink onto a recording medium and forms an image in the recording medium.

* * * * *